United States Patent [19]

Crinnion et al.

[11] Patent Number: 4,619,560

[45] Date of Patent: Oct. 28, 1986

[54] STRUCTURAL MODULE FOR RETAINING WALLS AND THE LIKE

[76] Inventors: Edward V. Crinnion, 15 Brookridge Dr.; James S. Crinnion, 75 Avonwood Rd., Apt. B6, both of Avon, Conn. 06001

[21] Appl. No.: 578,352

[22] Filed: Feb. 8, 1984

[51] Int. Cl.[4] ..... E02D 5/20

[52] U.S. Cl. ..... 405/284; 52/597; 52/604; 52/605

[58] Field of Search ..... 52/561–572, 52/589–596, 603–605; 405/284–286

[56] References Cited

U.S. PATENT DOCUMENTS

| | | | |
|---|---|---|---|
| 2,880,470 | 4/1959 | Pickersgill | 52/603 X |
| 3,269,125 | 8/1966 | Moore | 405/286 |
| 3,953,979 | 5/1976 | Kurose | 405/286 |
| 4,074,538 | 2/1978 | Janus | 405/284 X |
| 4,379,659 | 4/1983 | Steiner | 52/608 |

FOREIGN PATENT DOCUMENTS

| | | | |
|---|---|---|---|
| 2910526 | 9/1980 | Fed. Rep. of Germany | 405/284 |
| 2268116 | 11/1975 | France | 405/284 |
| 2436331 | 5/1980 | France | 405/284 |
| 78724 | 6/1980 | Japan | 405/284 |
| 256647 | 11/1969 | U.S.S.R. | 405/284 |

*Primary Examiner*—J. Karl Bell

*Attorney, Agent, or Firm*—Mandeville and Schweitzer

[57] ABSTRACT

A prefabricated concrete module and a composite wall structure comprised of an assembly of modules, where the module comprises a generally rectangular front and rear panel, joined by at least one generally trapezoidal partition means. A cellular wall structure is formed by stacking the modules and aligning the partition means on top of each other, thereby forming bins which contain loose material contributing to the weight of the structure. Provisions can be made for slabs which span longitudinally across partition means of vertically contiguous modules. These slabs, which capture an additional amount of loose material, can also, where desired, transfer lateral forces between superposed partition means. In a version of the module, useful whether or not the trapezoidal partition means are employed, the longitudinal distance from a partition to the edge of the front panel, is less than half the distance between partitions. By spacing these modules so that their front panels are longitudinally spaced apart, drop-in panels are able to be inserted, and a more economical wall structure can be assembled.

50 Claims, 52 Drawing Figures

FIG. 3
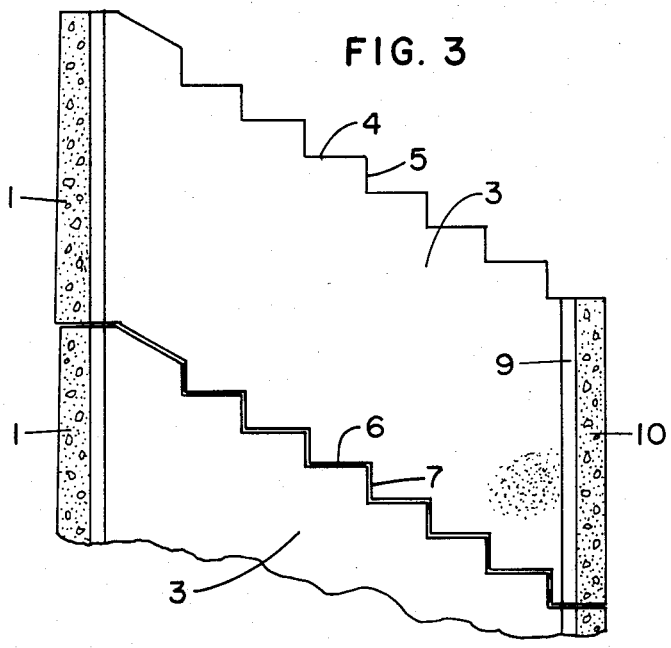
FIG. 5
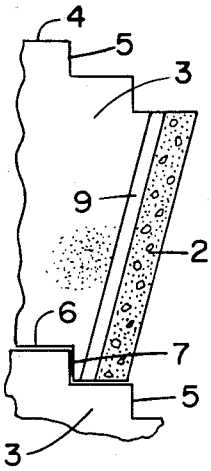
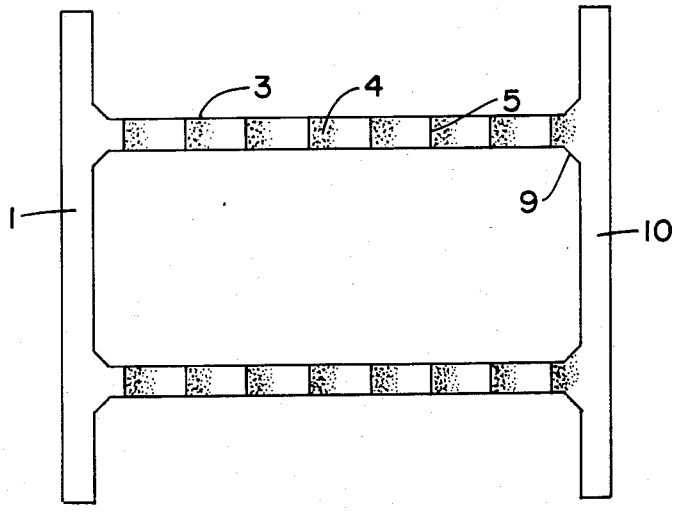
FIG. 4
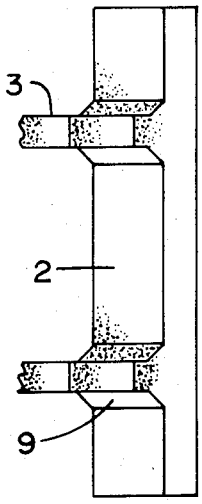
FIG. 6

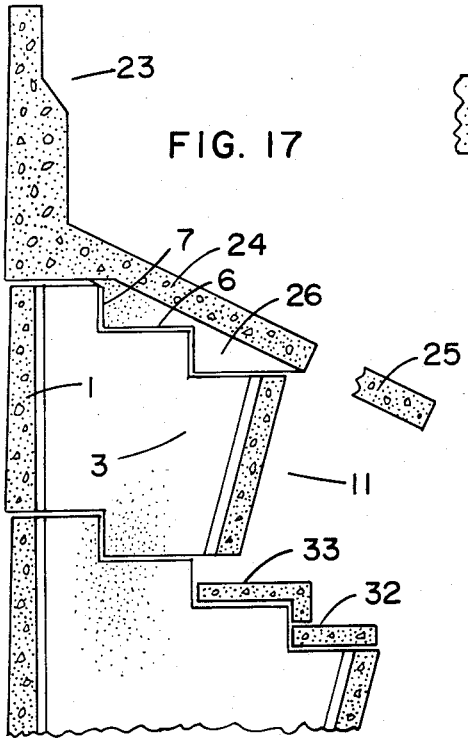
FIG. 17
FIG. 18A
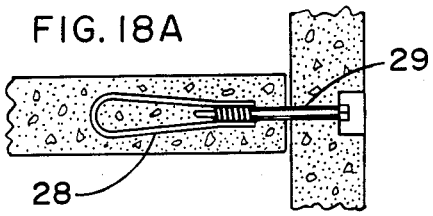
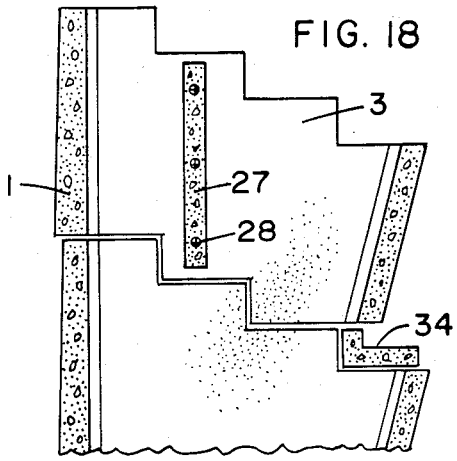
FIG. 18
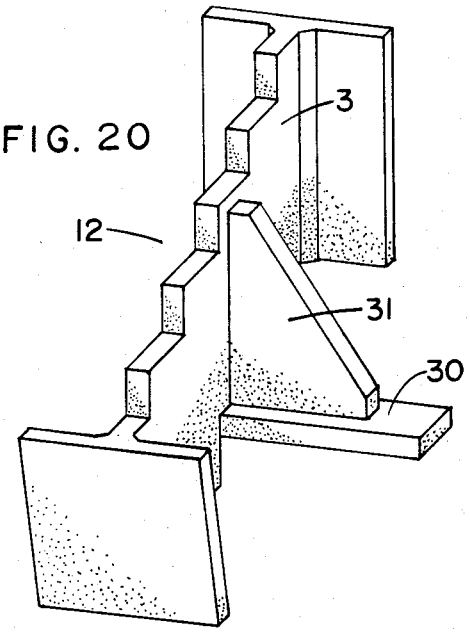
FIG. 20
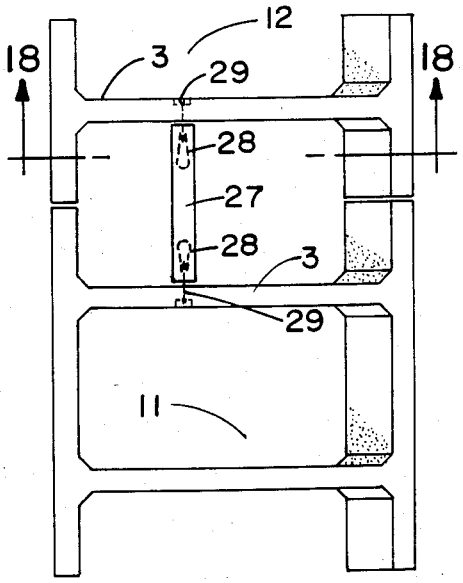
FIG. 19

FIG. 32
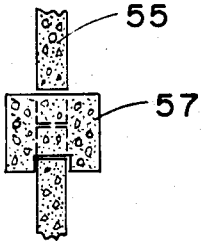
FIG. 31
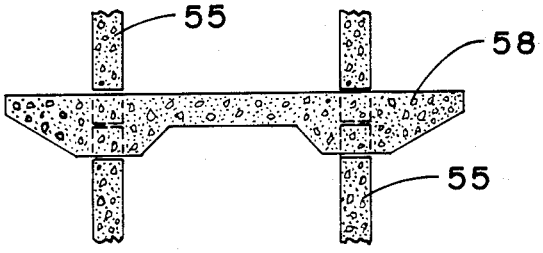
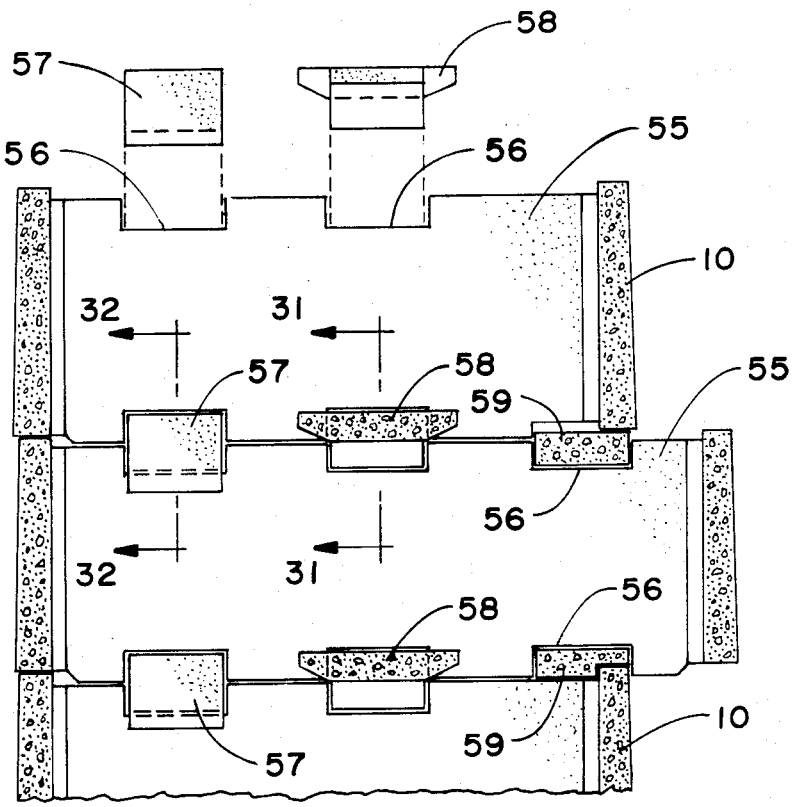
FIG. 34

STRUCTURAL MODULE FOR RETAINING WALLS AND THE LIKE

BACKGROUND OF THE INVENTION

This invention relates generally to specially configured prefabricated structural modules for employment in the construction of walls. More particularly this invention relates to that class of wall wherein the structural elements of the module form interior cavities or cells in which granular material is deposited. This enclosed granular material, through the action of friction against the generally upright walls of the cells, adds its own weight to that of the structural parts to form a more effective assembly.

The structural modules of the present invention are intended to be used in combination with other similar modules arranged in horizontal rows and, according to the height required of the structure, in additional superposed horizontal rows of modules each properly proportioned to provide adequate stability to the assembled structure.

More particularly the present invention relates to an improved prefabricated structural module of the general type shown in U.S. Pat. No. 3,877,236 and U.S. Pat. No. 4,372,091. These patents show structural modules which, when assembled in combination laterally and vertically to form a wall structure, create cellular cavities to contain fill material which acts in consort with the wall modules to form a gravity wall. The principal distinction between the referenced patents lies in the method utilized to transfer the lateral components of forces acting upon the walls.

In U.S. Pat. No. 3,877,236 the lateral forces are transmitted by interlocking contours located in the top and bottom surfaces of the face panels. This detail is effective for small to moderate lateral forces, but the stresses induced in relatively thin face panels by high lateral stresses in high structures cannot be economically resisted by these methods. U.S. Pat. No. 4,372,091 uses a standard mortise and tenon interlocking key located on the arm connecting the front and rear faces. The lateral forces in a wall constructed with these modules cause very high bending stresses in the connecting arms, since the mortise and tenon keys form couples which are transmitted to the face panels. The connecting arms must also resist high vertical shear stresses caused by these couples. The bending and shear stresses so induced must be resisted respectively by heavy longitudinal reinforcing steel and by vertical steel usually in the form of strirrups. These requirements add significantly to the cost of the modules and hence to the final cost of the structure.

An object of the present invention is to provide an improvement over other prefabricated modules presently used for wall structures of this type, since the modules described in this invention are configured in such a manner as to conform more efficiently to the locations, directions and patterns of stresses induced in the wall assembly by the fill material within and by the external loads acting upon the wall. By being positioned in such a manner as to be able to accommodate more efficiently the loads imposed upon it, the stability of the assembled structure is increased. Moreover, both the intensity of the internal stresses within the module, and the physical size of the individual modules are reduced. This more effective construction results in the use of less material in the manufacture of the modules and, when used in a retaining structure, requires less excavation of soil (and consequently, less backfill material to be placed) to place the modules in the field and to complete the structure. All these factors combine to produce a much more economical structure with improved structural integrity.

SUMMARY OF THE INVENTION

In order to accomplish the objectives of the present invention, a precast structural module is configured as follows: A front panel is provided which typically is of generally rectangular configuration when viewed in front elevation. A rear panel is located with its longitudinal axis parallel to that of said front panel, and one or a plurality of partition means connect said front panel with said rear panel. When said modules are placed in lateral contiguity, the front panels and rear panels form two opposite longitudinal sides of a cellular chamber, with each partition means serving to connect the front panel with the rear panel, and further serving to transversely divide the chamber into smaller individual cells.

In a particularly advantageous form of the present invention, the partition means are of a pronounced generally trapezoidal shape when viewed along a horizontal line parallel with the longitudinal axis of the front panel. (For the purpose of this application, the term "trapezoidal" includes a parallelogram.) This trapezoidal shape is such that, when the module is placed in its final erected position within the assembled wall structure, the rear panel of a module is situated at an elevation considerably below a plane extending from the upper edge of the front panel at right angles thereto, and the principal axes of the partition means extend in a downward direction, desirably at an angle of between 20 and 82 degrees from the plane of the front panel. This results in the axes of the partition means being more nearly perpendicular to the direction of the resultant forces acting on the wall modules. These forces represent the combined effects of (a) the lateral force caused by the material retained behind the wall, and (b) the vertical gravity forces from the modules themselves and from the fill enclosed within the cellular cavities formed by the front and rear panels and the partition means of the assembled modules.

In a wall where modules are stacked vertically, each module beginning with the topmost module is acted upon by its respective overturning and resisting forces and subsequently transmits those forces to the contiguous module(s) below according to the details of the transfer mechanism provided in the design. Such mechanisms have heretofore consisted of commonly used interlocking means such as mortise and tenon keys on connecting arms or depended lips on the lower surfaces of the face panels. The use of mortise and tenon keys in the partition means results in very heavy bending stresses in the partition means as well as high local shearing stresses in the keys. The use of depending lips in the face panels results in excessively high shearing stresses and bending in the weaker direction of the panel. This factor seriously limits the useful height of the design since these stresses when high cannot be resisted by any economically practical thickness of face panel or depending lips.

Since concrete, the material commonly used in the manufacture of wall modules, is relatively weak in tensile strength, bending in concrete members must be resisted by reinforcing material, usually steel, located longitudinally in the tension face of the member. A very significant aspect of one form of the present invention is the ability of the design to transmit the natural stresses of the retained material and those of the resisting material directly as compressive forces, without relocating those forces through excessive and inefficient use of expensive reinforcing materials.

The present invention is not restricted to the use of any particular material of construction, but concrete, either plain or reinforced by metal embedded therein in the usual way, is very suitable and advantageous. The invention utilizes most effectively and economically the very efficient natural compressive strength of concrete.

To affect this natural ability of concrete to transmit stresses compressively, one precept of this invention prescribes a variation of configurations of the contact surfaces of vertically contiguous partition means, each embodiment utilizing the advantages of a generally sloped orientation of the contact surfaces of the partition means. In its simplest form, the contact surface consists of a straight inclined plane oriented in such a way that the total resultant forces, overturning and resisting, exerted by the upper module upon the lower module, occur at such an angle that ordinary frictional forces between the surfaces in contact more than compensate for any component of the resultant force which may occur in a direction parallel to said contact surfaces. Another form of this invention utilizes a more positive engagement of contact surfaces wherein alternate surfaces are angled with respect to each other, presenting surfaces normal to any resulting components of loading.

DESCRIPTION OF THE DRAWINGS

FIGS. 3 and 4 are cross sectional and top plan views respectively illustrating a module of the general type shown in FIG. 1, with parallel front and rear panels.

FIGS. 5 and 6 are fragmentary cross sectional and plan views, similar to FIGS. 3 and 4, illustrating a modification in which the rear panel is tilted at an acute angle to the front panel.

FIGS. 14 and 15 are cross sectional views taken on lines 14—14 and 15—15 of FIG. 16 illustrating advantageous forms of construction for the tops of retaining walls or the like.

FIG. 17 is a fragmentary cross sectional view illustrating another form of top structure for a retaining wall or the like.

FIG. 18 is a cross sectional view generally on line 18—18 of FIG. 19.

FIG. 18*a* is a fragmentary cross sectional detail, illustrating an advantageous form of connector for joining a connecting panel to adjacent structural modules.

FIG. 19 is a top plan view of an arrangement for joining so-called half modules to adjacent structural modules by means of an intermediate connecting panel.

FIG. 20 is a perspective view of a modified form of half module having an integral stabilizing slab.

FIGS. 31 and 32 are fragmentary views in vertical cross section illustrating advantageous arrangements for keying together vertically adjacent structural modules for resistance to shear.

FIG. 34 is a cross sectional view of an assembly of structural modules arranged with notched-out partition panels and with adjacent structural modules being joined by special keying blocks or slabs.

PREFERRED EMBODIMENTS

Figure 1:
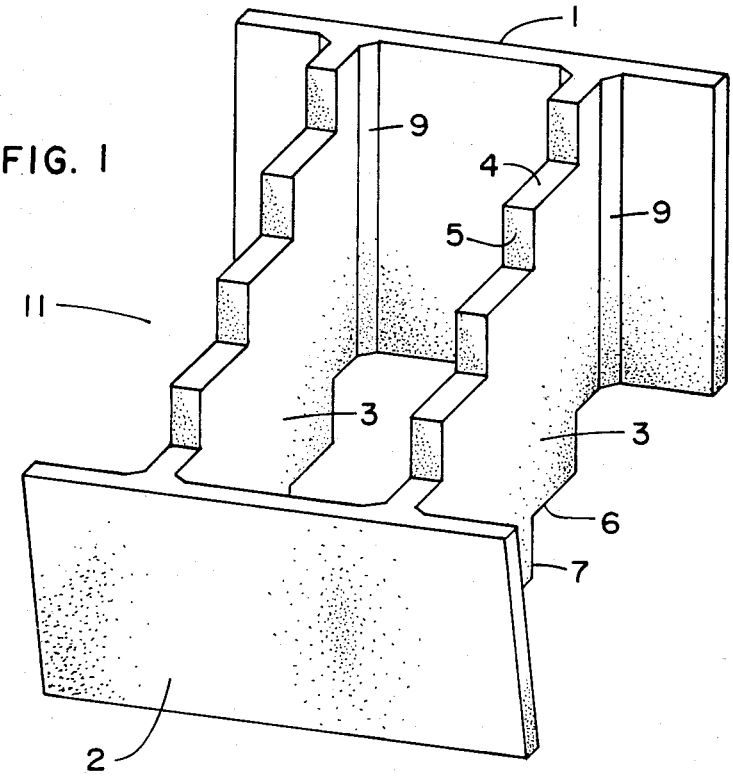
FIGS. 1 and 2 are perspective views of advantageous forms of structural modules incorporating features of the invention.

FIGS. 1 through 6 illustrate some of the more preferred embodiments of a module with trapezoidal partition means. The modules comprise rectangular front and rear panels, and trapezoidal partition elements, the upper surfaces 4 and 5, and the lower surfaces 6 and 7 of which are arranged in matching sawtooth pattern capable of positive unilateral interlocking of one module with another when one of said modules is superposed upon another. FIG. 1 is a perspective view of a module 11 with a front panel 1, a rear panel 2, and generally trapezoidal partition elements 3. Usually, but not necessarily, there are two spaced partition elements 3, panel-like in form. At the intersection of the panels with the partition elements are fillets 9 which are placed according to usual practice.

Figure 2:
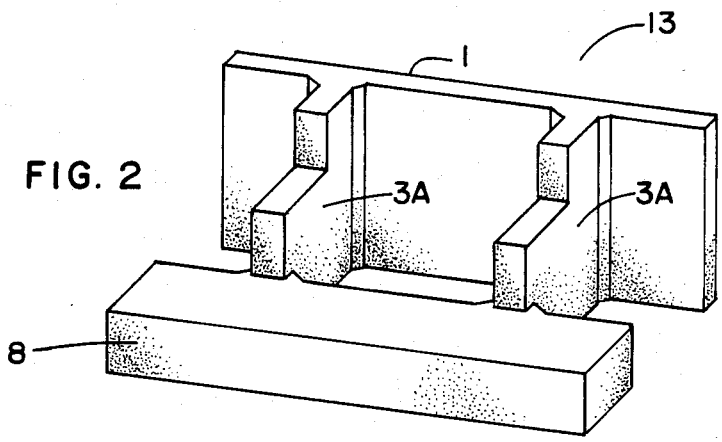

FIG. 2 represents a similar module 13, specially designed, however, for use at the base of a wall assembly. The partition elements 3A, ordinarily trapezoidal, have been, in this particular case, truncated to allow the bottom surfaces thereof to lie along the plane of the wall's foundation. The rear panel 8 is shown in a special configuration more suitable for a base module, where its plane is perpendicular to the plane of the partition means 3A and approximately perpendicular to the plane of the front panel 1. The rear panel 8, as shown, has a marked advantage when used as an element of a base module. Its horizontal orientation forms a shelf which positively captures the force from the weight of the fill above it, and is located approximately at the center of action of the resultant force combining the vertical gravity loads with the lateral overturning loads. It is capable of behaving as a spread footing, distributing the loads from the superposed modules above, and from the fill they contain.

The rear panel of any module may be either substantially perpendicular to the front panel, as in FIG. 2, substantially parallel with the front panel, as in FIGS. 3 and 4, or inclined at an acute angle with respect to the plane of the front panel, depending upon the particular purpose to which it is to be applied. When a smaller module is to be used below a larger module, at the base of the wall, a rear panel 8 which is substantially perpendicular to the front panel 1 of the module is especially beneficial. When it is desired to use the rear panels to assist in transferring weight between modules, such as in a bridge abutment, it is preferred that the rear panels 10 be parallel with the front panel 1 (FIG. 3) so the rear panels can be readily aligned. When it is desired to increase the forces resisting overturning it is beneficial to tilt the rear panel 2 at an acute angle with the front panel 1, with its upper edge farther away from the front panel, as illustrated in FIGS. 5 and 6, so as to increase the amount of fill captured, and to reduce simultaneously the lateral pressure exerted by the retained material behind the module.

FIG. 3 clearly shows a cross sectional view of one of many sawtooth patterns made according to the invention. A plurality of surfaces 4 and 5 form the upper sawtooth edge and a plurality of surfaces 6 and 7 form the lower matching sawtooth edge. In one form of the invention, surfaces 4 and 6 do not come in contact with each other, and the component, parallel to the plane of the front panel, of the resultant of all forces acting upon the module, is carried by the front and rear panels and transmitted to the front and rear panels of the lower module at the panels' respective contact surfaces. The component, perpendicular to the plane of the front panel, of the resultant of all forces acting upon the superposed module is transmitted from contact surface 7 to contact surface 5 of the supporting module and is carried by the partition means 3 of the supporting module. In a preferred form of the invention, all surfaces 6 and 7 come in contact with their respective matching surfaces 4 and 5 and each surface bears a proportionate amount of the component, perpendicular to the contact surface, of the resultant of all forces acting upon the module. In a further preferred form of the invention, the modules are constructed to dimensions which prevent the transmission of major forces from one face panel (i.e., front or rear panels 1, 2 or 1, 10) to another. This feature minimizes the occurrence of cracking in said pnaels.

FIGS. 5 and 6 show in side view and plan view the rear panel 2 tilted in a manner which increases the force it receives from the bin-action effect of the fill within the cells of the module while at the same time reducing the lateral force it receives from the retained material. It produces an additional benefit when modules of the same dimensions are stacked, one upon the other, by creating a protruding top surface which captures the beneficial downward force of retained material located in a zone above the protruding parts of the module. For the tilting to be worthwhile, the back panel 2 should be at least about 8 degrees with respect to the front panel.

Figure 7:
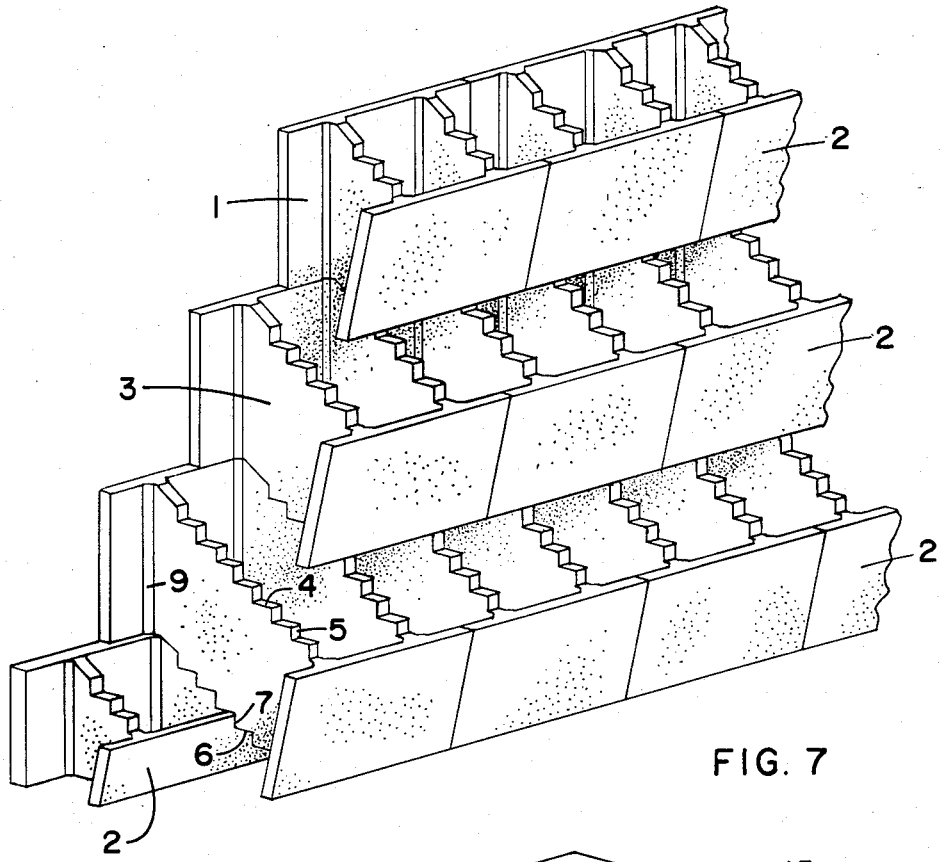
FIG. 7 is a fragmentary perspective view of an assembled retaining wall or the like utilizing structural modules according to the invention.

FIG. 7 shows a perspective view of an assembly of modules arranged laterally in horizontal rows with additional horizontal rows of modules superposed above. The assembly as seen in FIG. 7 is of a wall structure viewed from the rear. The assembly of front panels 1 form the exterior face of the wall structure. The rear panels 2 are shown at an acute angle with respect to the plane of the front panels. With the exception of the base module, each superposed module is shown with its partition means of lesser width than the partition means of the module upon which it is supported. This method of stacking is also shown in cross-sectional view in FIG. 11 and represents the standard method of stacking when constructing a modular gravity retaining wall. As shown in FIG. 7 the base module is a form of the new module with its bottom portion truncated to conform to the plane of the subgrade. The base module is of smaller width than the module directly superposed on it because the heel of the wall is the bottom edge of the rear panel of the module resting on the base unit and is substantially at the elevation of the base module's subgrade.

Figure 8:
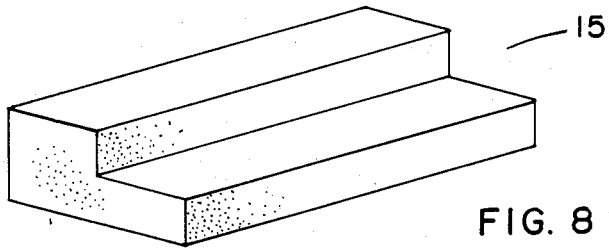
FIG. 8 is a perspective view of a base of a type which may be used in connection with a wall assembly such as that of FIG. 7.

FIG. 8 shows a solid base. This type of base may be used for smaller walls where the extra material used would be less expensive than the cost of forming the empty cells.

Figure 9:
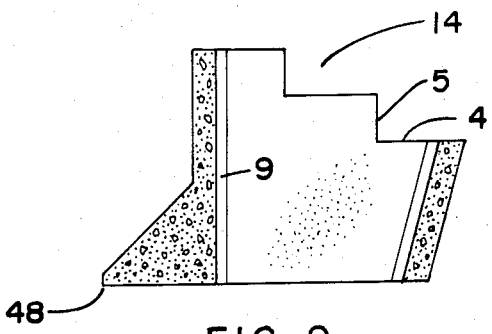
FIG. 9 is a cross sectional view of a preferred form of base module according to the invention having an extended toe flange for increased resistance to overturn.

FIG. 9 shows a base module 14 with the lower exterior edge of its front panel extended a substantial distance. This module, by extending the pivot point 48 about which the wall assembly could rotate, increases substantially the wall's resistance to such rotation. This improvement is particularly effective for walls with trapezoidal partition means and/or lowered rear panels.

In the analysis of a modular retaining wall for stability against overturning, when the wall is one in which modules of different size or shape occur in any vertical stack, it is necessary to investigate the stability of the structure above each possible pivot point. It is readily apparent from FIG. 11 that the inclined trapezoidal shape of the partition means and lowered position of the rear panel results in several advantages. It substantially lowers the center of gravity of each of the stacked modules and likewise lowers the center of gravity of the granular material enclosed within each of the cells of the modules. In that part of a wall in which the rear face is stepped toward the front face as the courses progress upward, the trapezoidal shape of the partition means also lowers the center of gravity of the retained material trapped above the protruding rear portion of the modules.

Figure 13:
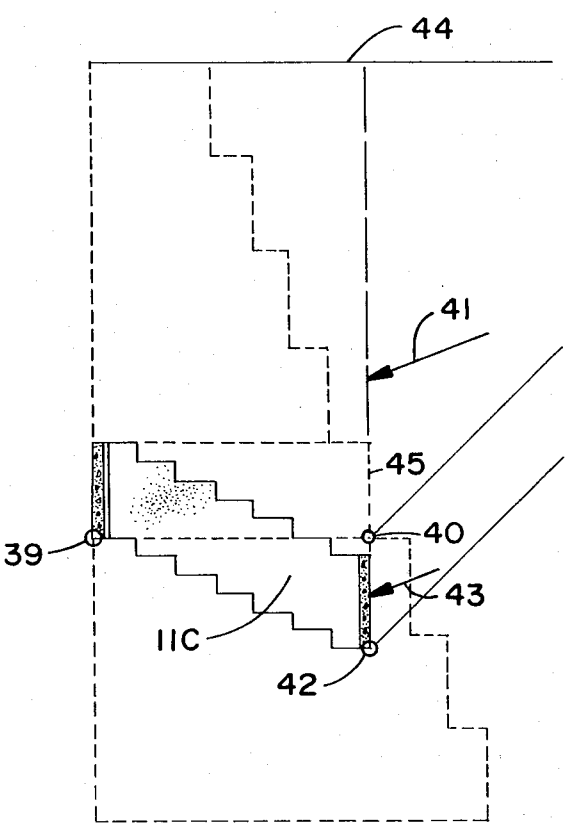
FIG. 13 is a diagrammatic illustration of a structural wall utilizing the modules of the invention, for force analysis purposes.

The inclined trapezoidal shape of the partition elements and the lowered position of the rear panel has another important effect on the behavior of the modular wall. In the analysis of the complete wall, when investigating the tendency of the bottommost module course to overturn about the toe, or to slide along the base, the lowered position of the rear panel has no effect, either beneficial or detrimental. However, when analyzing the stability of the individual courses above the bottom course, the advantages of the new design are substantial. Referring to FIG. 13, if we perform an overturning analysis about point 39, the pivot point of a typical module 11C, which lies in an arbitrarily chosen upper course of the wall, the improvements become evident. The resultant of those forces causing overturning, as well as the resultant of those forces affecting resistance to overturning, are substantially lowered in elevation. Although the overall magnitude of the overturning force is increased, its effectiveness nevertheless is reduced. At the same time, both the magnitude and the effectiveness of the beneficial resisting forces are increased.

To illustrate in more detail the effect of a lowered rear panel on the behavior of the force tending to cause overturning, refer to FIG. 13. In the analysis of a standard wall built according to the present state of the art, the rear panel 45 is, within the tolerances of usual wall batters and construction accuracies, at the same elevation as the front panel. This condition is illustrated by the dashed lines in FIG. 13. Taking the summation of moments about pivot point 39 the lateral overturning force 41 caused by the retained material above the heel 40 acts at an elevation approximately one-third the distance from the elevation of the heel 40 to the surface 44 of retained material. In contrast, in the analysis of the wall built according to the teachings of the present invention shown by solid lines in FIG. 13, when we take the summation of moments about the same pivot point 39, the lateral overturning force now consists of the combined effects of the same overturning force 41, plus the overturning force 43 due to the additional volume of retained material between point 40 and the new heel 42. The additional force 43, although increasing the total horizontal force against the wall, actually has a stabilizing effect since its line of action lies below the elevation of the pivot point 39. Thus the total effective overturning moment is in fact reduced, and the size and weight of the wall structure including module 11C and those modules above it may be reduced in size, thereby affecting a more economical construction.

In the analysis of overturning conditions for the entire wall it is necessary to evaluate moments about the base at pivot point 47 (representing the pivot point location in a standard wall). Since the heel 46 of the entire wall is at the same elevation as pivot point 47, there is no benefit from the trapezoidal partition means, and the overturning condition is the same for the standard wall and for the wall according to the invention. When the base module is fabricated with its lower edge extended forward from the face, forming the pivot point at 48 (see FIGS. 9, 11), overturning moments are reduced, and resisting moments are increased.

Figure 12:
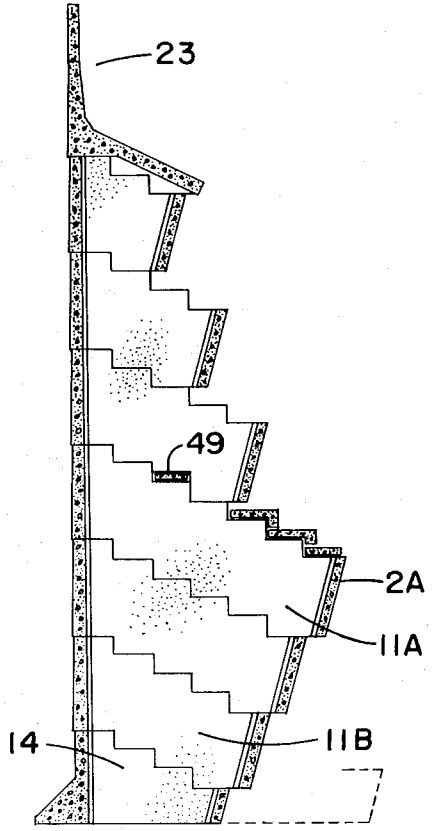
FIGS. 11 and 12 are cross sectional views illustrating different advantageous construction techniques utilizing the structural modules of the invention.

FIG. 12 illustrates an assembly of modules according to the invention arranged in a more beneficial sequence of sizes. In this type of stacking, the rear panel **2*a* of module 11A, which extends farthest away from the front panel, is located a substantial distance above the elevation of the base module 14. The rear panel 2A acts to protect each of the rear panels beneath it from the full effects of the retained material. The overall effect is to reduce substantially the amount of material used to construct the wall and to require substantially less material (e.g. earth) to be removed prior to construction. A wall with less required height can be built using the same principle, in which case module 11B** might be the farthest extending module with all superposed modules of smaller size.

Figure 10:
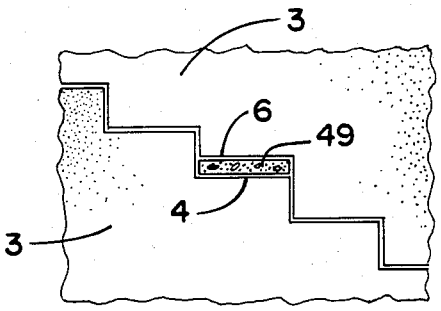
FIG. 10 illustrates a modified form of structural module, having a notched-out area for reception of a horizontal, earth-retaining slab.
Figure 11:
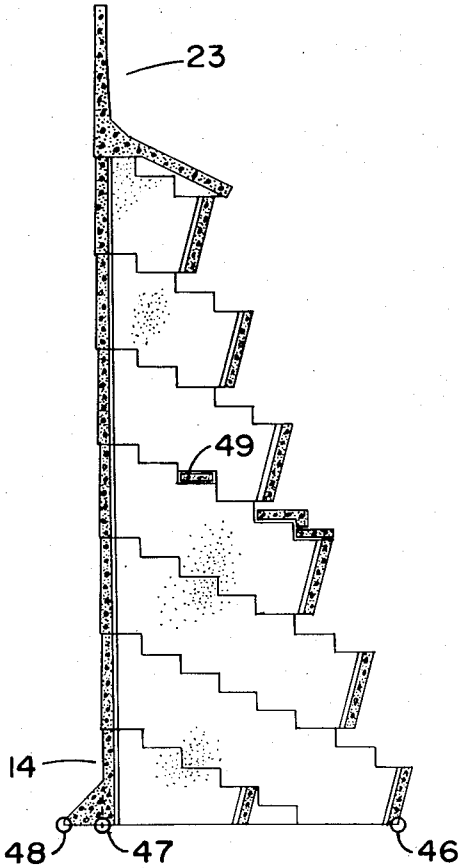

FIGS. 11 and 12 also show the location of an auxiliary feature which is detailed in FIG. 10. This is a prefabricated slab or plank 49 which can be placed between contact surfaces 4 and 6 of superposed partition elements. To incorporate the slab 49 in an assembled structure, either or both surfaces 4, 6 must be molded in such a manner that adequate space is allowed. If the proper space is allowed, the partition means will behave the same as it would without the space, but an additional beneficial action is obtained. The slabs 49, extending into the fill material contained in the cells of the modules, form shelf-like members which engage the weight of fill material above in a more positive manner than does the bin-action against vertically extending panels and partitions.

Thus, the slab 49 increases the ability of the fill material to act in concert with the cellular wall structure. Slab 49 may be made to span between adjacent partition means or to cantilever from both sides of a partition means. The most preferred method would be to span between two or more partition means and to cantilever at each end, reaching approximately half the distance to the next partition means.

Figure 14:
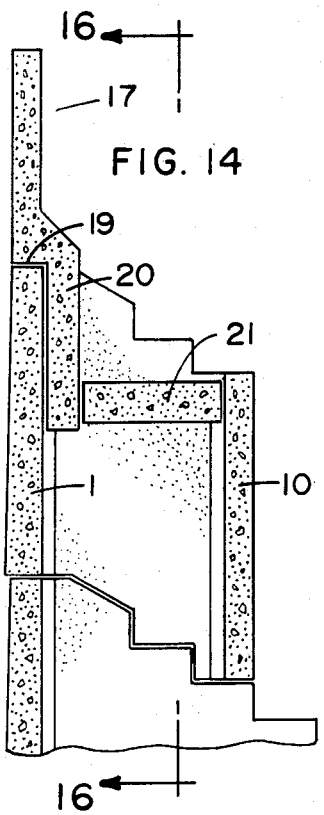
Figure 15:
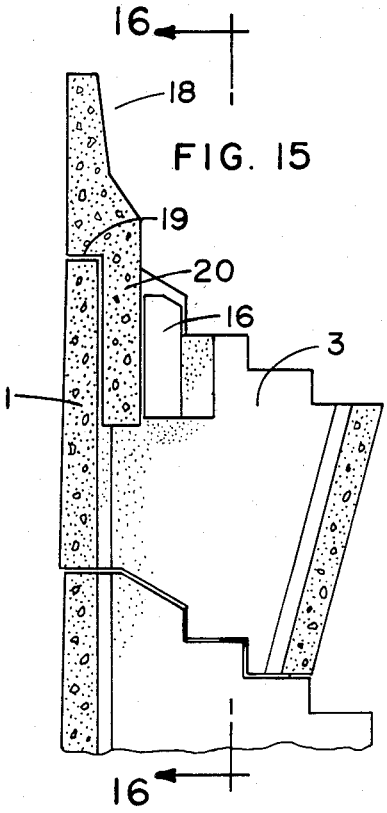
Figure 16:
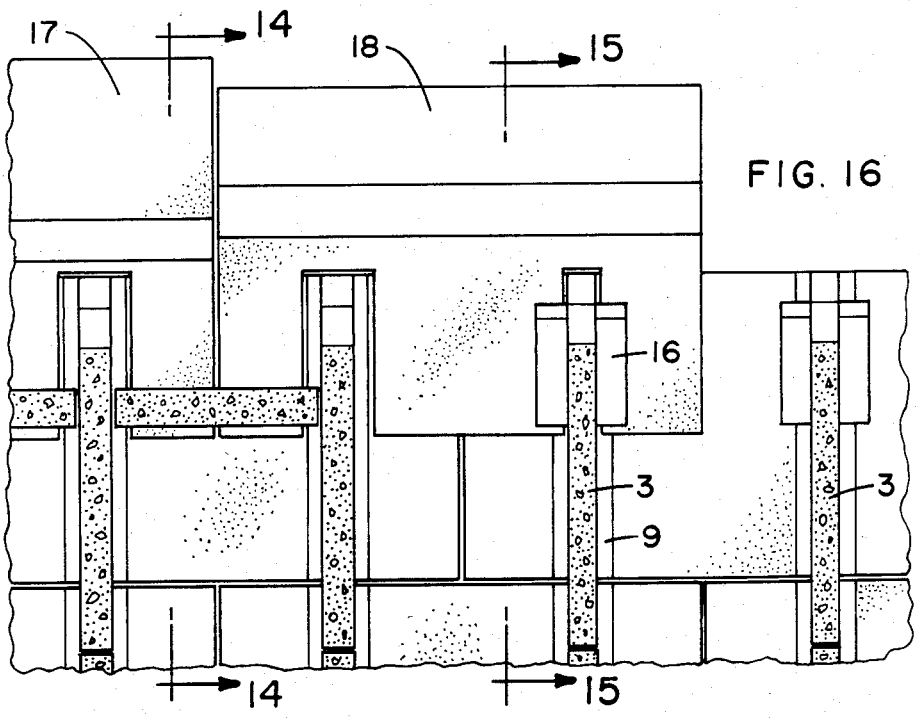
FIG. 16 is a composite cross sectional view illustrating the construction features of FIGS. 14, 15.

In FIGS. 14, 15 and 16 there are shown two methods of constructing the tops of walls. The top-most front panel shown is a cantilevered panel 17 or 18 with offset arms 20 set vertically behind the front panel 1 of a module. The vertical load from the panel is transmitted to the top of the front panel 1 by bottom surface 19 of the offset shoulder. Horizontal loads against the top portion of the cantilevered panel are resisted by cantilever action of the panel with the restraining thrust supplied by thrust blocks. Two forms of thrust blocks are shown. In FIG. 14 the thrust block is shown in the form of a plug 21, which may be prefabricated or cast in place, and which extends rearward to the inner face of the rear panel 10. In FIG. 15 the thrust block 16 is attached to the partition means 3, either integrally or by connecting means.

FIG. 16 is a cross-sectional view looking forward at the rear faces of the cantilevered panel and of the front panel. The left portion of FIG. 16 shows the construction as in FIG. 14, while the right portion of FIG. 16 shows the construction as in FIG. 15. The rightmost partition means shown in FIG. 16 is shown prepared to receive a cantilevered panel. Cantilevered panels are more economical to construct than are cellular modules and may be shaped for special applications such as parapets and may include special shapes as for traffic barriers. Cantilevered panels are able to protrude further above the finished grade and their top edge may be fabricated at an angle with respect to the horizontal to conform to a specified grade (See FIGS. 21, 22).

Cantilevered panels 17 may be used in lieu of a top module in walls whether or not parapets are required.

Figure 47:
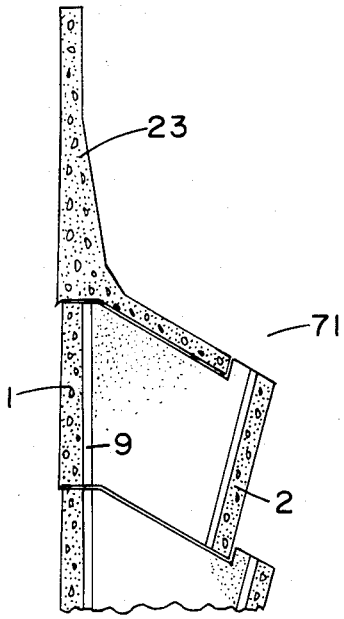

FIG. 17 illustrates a top unit 23 in the form of a V-shaped cantilever. This unit also may be used in lieu of a top module where a parapet is not required, as shown in FIGS. 11, 12 and 47, or it may be used as shown in FIG. 17 where it is indicated as a parapet with an integral traffic barrier. The vertical and horizontal loads from unit 23 are transmitted to the top module by ribs 26 fabricated along the soffit of the inclined slab 24. Ribs 26 are fabricated with contact surfaces 6 and 7 which conform to the contour of the tops of partition means 3 of modules 11. Thus these forces are transmitted in the same manner as they are from superposed module to supporting module in a basic wall structure with a sawtooth pattern in the joints of the partition means. Resistance to overturning is provided to the top unit 23 by the weight of fill supported by slab 24. Whenever it is desired to provide additional stability to unit 23, the slab 24 may be extended as indicated by 25. Since extending slab 24 causes the edge to descend deeper into the fill as well as rearward, it can be seen that the V-shape of unit 23 is more effective than an L-shaped unit would be. The V-shaped unit also allows more space for underground structures such as utility structures.

FIGS. 17 and 18 show prefabricated rear slabs 32, 33 and 34. Slab 32 is planar while slab 33 has a depending flange and slab 34 has an ascending flange. Slabs 32, 33 and 34 are able to positively engage the retained material above them in a location which is the most beneficial, the rear of the module.

Figure 21:
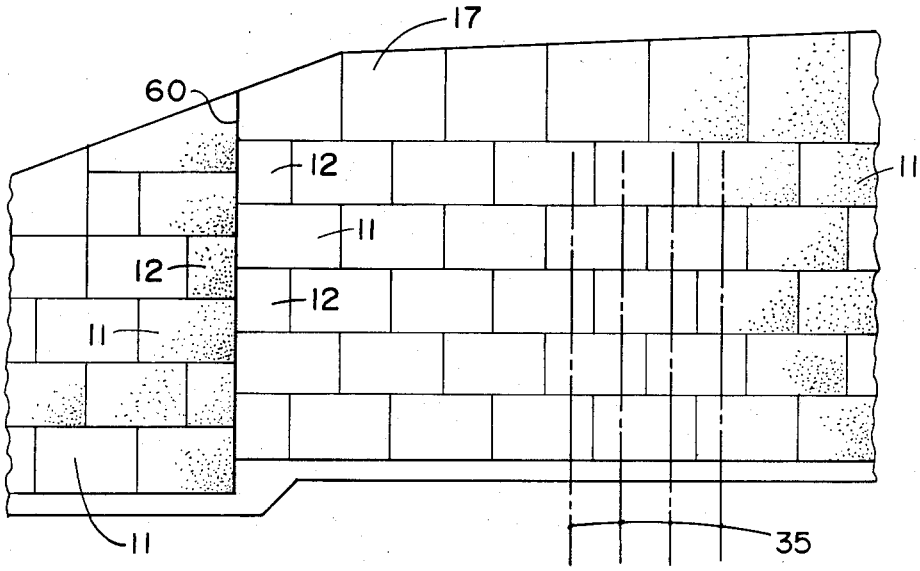
FIG. 21 is a front elevational view of a retaining wall or the like constructed with structural modules according to the invention.

FIG. 21 shows a front elevation of a wall assembly using modules 11 and cantilevered panels 17. The modules are arranged to stagger the vertical joints so that each superposed module, where possible, is supported by two different modules in the course below it. To accomplish this preferred interlocking pattern, the partition means are spaced apart at virtually twice the distance from the partition means to the lateral edge of the front panel 1 of modules 11. The center lines 35 of a few adjacent partition means are shown. As can be seen, this spacing allows all the partition means to occur in continuous planes from top to base as required in the invention, and also allows the lateral edges of the front panels essentially to touch.

It is often necessary in the construction of a wall to provide continuous vertical joints at certain locations such as: expansion joints, turning points where the direction of the wall changes, locations where it is desirable to change horizontal joint elevations, and settlement joints where there is a significant change in the expected settlement of a foundation. Such a joint 60 is shown in FIG. 21. Because of the pattern where each module overhangs half of a module immediately below it, it is neccessary to provide half-modules 12 adjacent to the joint in alternating courses as indicated.

FIG. 20 shows a half-module 12. Since the module possesses only one partition means, it is necessary to provide a laterally stabilizing mechanism. One such mechanism is shown in FIG. 20. A slab 30 dimensioned to bear on a contact surface 4 is cantilevered from the half-module's partition means 3. A gusset panel 31 is provided for rigidity and strength. In the full size module 11 adjacent to the half-module 12, one of the contact surfaces 6 is cast at a higher elevation than is normal to provide for the thickness of slab 30. When slab 30 is locked between the partition means of two modules, half-module 12 is laterally stabilized against rotation.

An alternate method of lateral stabilization is illustrated in FIGS. 18 and 19 where a lateral diaphragm panel 27, generally vertically disposed, is provided to span between the partition means of the half-module to the nearest partition means of the adjacent module. The diaphragm panel 27 is connected to the partition means by threaded inserts 28 and connectors 29, of a type similar to those shown in FIG. 18*a*.

Figure 22:
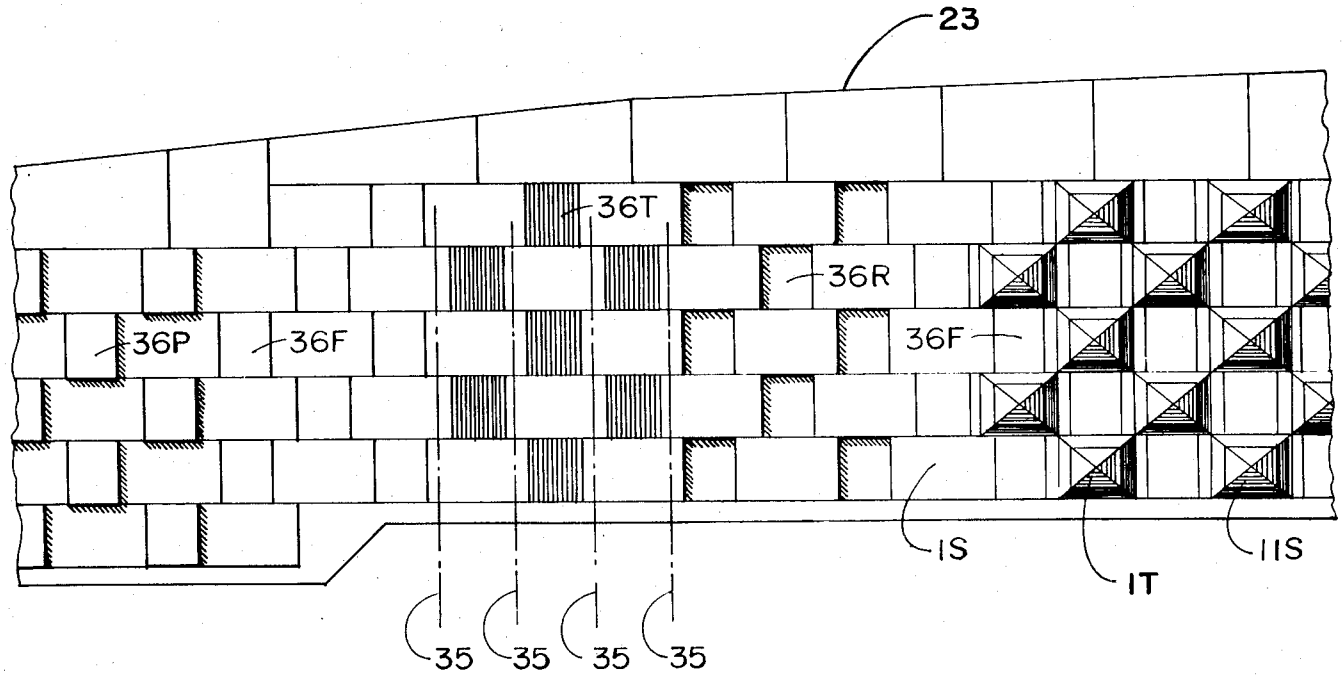
FIGS. 22 and 22A are front elevational views of modified forms of retaining wall assembly or the like incorporating filler panels between adjacent, spaced structural modules.
Figure 28:
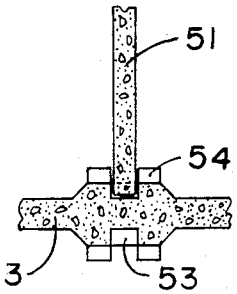
FIGS. 28–30 illustrate various views of an arrangement for mounting of the drop-in panel in an assembly of modules.
Figure 30:
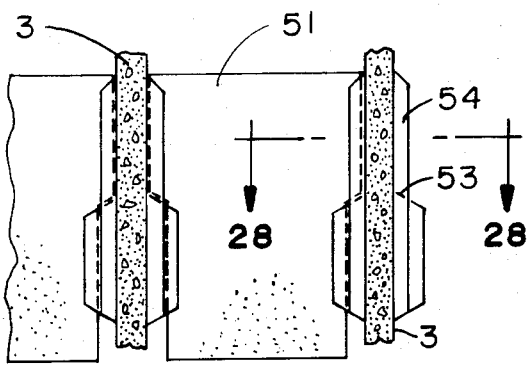
Figure 29:
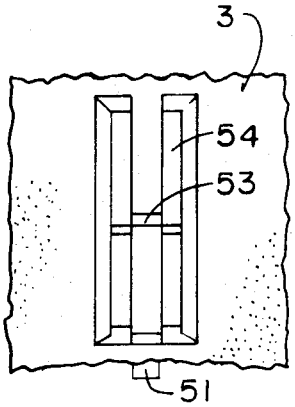
Figure 23:
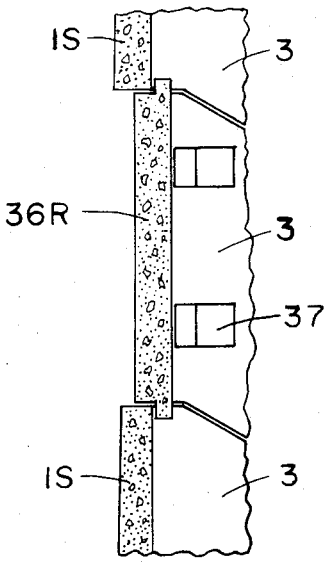
FIGS. 23–26 are fragmentary cross sectional and top plan views illustrating various arrangements for the mounting and retention of filler panels in a wall assembly of the type shown in FIG. 22.

FIG. 22 shows a new and improved arrangement in the assembly of cellular modules 11S. Partition means are spaced as shown by center lines 35 except that, in the arrangement in FIG. 22, the spacing between the partition elements is substantially greater than twice the distance from the partition elements to the lateral edge of the front panels 1S. This pattern results in significant benefits. When the partition means are erected in vertical alignment with the left partition means of each superposed module 11S supported by the right partition means of the module below it, and the right partition means supported by the left partition means below it, a substantial space is left between ajacent front panels 1S and adjacent rear panels. This space is filled by a drop-in face panel 36 between front panels and a drop-in panel 51 at the rear of the space between modules. Panel 51 may be parallel to the front panels or set at an angle thereto. The rear drop-in panel may be secured by a device such as the detail of bearing surface and ribs shown in FIGS. 28, 29 and 30. The ribs 54 shown in FIG. 29 may be tilted to accomodate an inclined drop-in panel 51. This unique arrangement increases the face area of the wall approximately 50 percent per module. The improved arrangement of modules shown in FIG. 22 may also be used with equal advantage in the assembly of modules with non-trapezoidal partition means.

Since it is more economical to fabricate and place the planar panels 36 and to strengthen the modules for the additional loading, than to construct additional modules for the equivalent area, the cost savings realized are substantial. Planar panels have an additional advantage in that they may be cast flat and therefore are less expensive to mold, easier to cast with textured surface 36T or in bas-relief as are panels 1T of modules 11S. The panels may be recessed behind the front panels 1S as are drop-in panels 36R or may protrude forward of the front panels 1S as do drop-in panels 36P. These treatments produce decorative shadows on the face of the wall and improve the appearance of the structure, especially in the case of large face areas. Shadow effects may also be produced by texturing or casting three dimensional patterns on the front panels 1S of the modules 11S as shown in FIG. 22. A similar effect may be obtained in front panels 1 of modules 11 (FIG. 21).

Figure 22A:
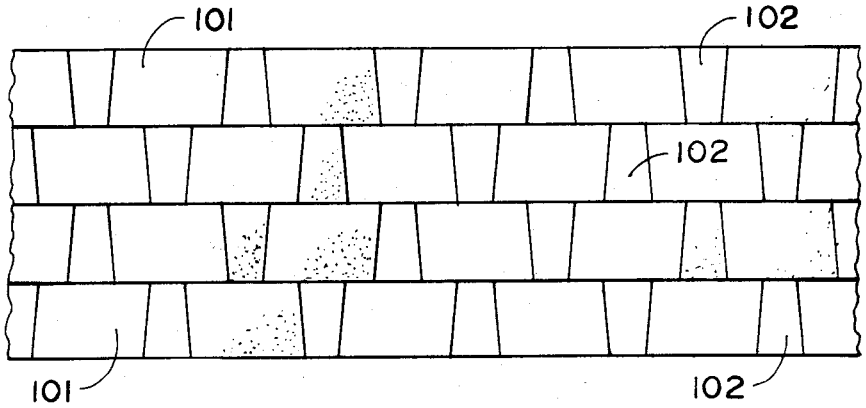

FIG. 22 shows various aesthetic improvements which may be used to interrupt the monotony of a wall surface, especially one of relatively large area. The pattern of front panels shown in FIG. 22 may be changed in various other ways to improve appearance. One such method, shown in FIG. 22A, would be to cast the front panels 101 in the form of parallelograms (as seen when viewed in front elevation) preserving horizontal top and bottom edges. If alternate front panels were first right-leaning and then left-leaning, the space created between them would be in the form of a trapezoid in the plane of the front panels. FIG. 22A shows a front elevation of a wall with parallelogram-shaped front panels 101 and trapezoidal filler panels 102 secured in a manner similar to that holding drop-in panels 36F, 36P, 36R, 36T in FIGS. 22 through 26.

Figure 25:
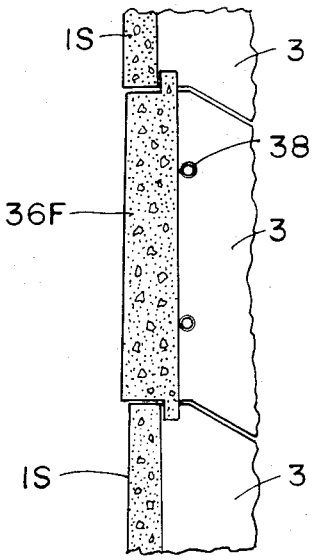
Figure 24:
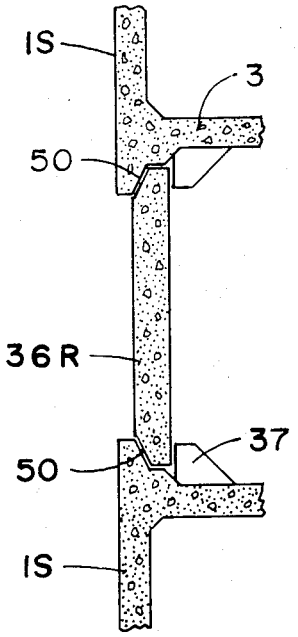
Figure 26:
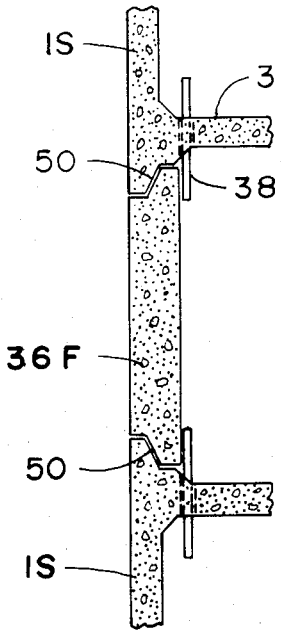

Methods of securing the drop-in panels are shown in FIGS. 23, 24, 25 and 26. A recessed drop-in panel 36R is shown in cross sectional view in FIG. 23 and in sectional plan view FIG. 24. It is supported vertically on the top surface of front panel 1S, is restrained from moving rearward during erection by lugs 37, and is further supported laterally before and after the fill is placed inside the cell, by the shear-transfer joints 50. FIGS. 25 and 26 show a similar method of securing a drop-in panel. In the example shown a flush drop-in panel 36F, is temporarily secured rearwardly by loose dowels 38 placed in matching holes cast in the partition means.

Figure 27:
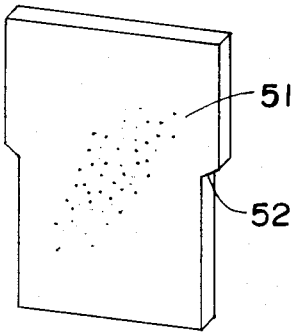
FIG. 27 is a perspective view of an advantageous form of drop-in panel, which may be used at the back of the assembly or, more typically, as an intermediate vertical panel.

In certain large modules, it may be desireable to include one or more dividing intermediate panels behind the front panel to improve the ability of the cellular structure to capture the weight of the fill material. Such panels may be either parallel to or inclined with respect to the front panel and may be either cast integrally with the modules or of drop-in design. An improved form of drop-in panel 51 is shown in FIG. 27 and is provided with tapered bearing surfaces 52 which rest on matching tapered bearing surfaces 53 located in notched brackets on the sides of the partition means of selected modules. The panel 51 is restrained laterally by the ribs 54 which extend almost the full height of the panels. The detail shown provides for efficient lateral restraint and transfer of vertical loading. Drop-in panel 51 may also be used as a drop-in rear panel in walls assembled as shown in FIG. 22.

It is more beneficial to capture the weight of the fill material at the rear of a module than to capture an equivalent weight of fill material at the front of the module because of the difference in moment arm. By moving a drop-in panel located between the front panel and rear panel of a module rearwardly or by tilting it so that its top is closest to the front panel and its bottom is closest to the rear of the module, the bin-action of the rear cell formed by the panel is improved while the bin-action of the cell forward of the panel is reduced. Hence overall stability of a module can be improved by proper placing and tilting of the drop-in panels.

When the rear panel of a module is located sufficiently forward of the rear panels of modules below so that the tilting of the rear panel has no effect on the magnitude or direction of the overturning force exerted by the retained material against the entire wall structure, then it is appropriate to tilt the panel forward so as to cause the direction of the force exerted by the retained material against the rear panel of this module to be located at a more vertical angle and to be greater in magnitude. These forces can be translated into improved resisting moments for the overall wall structure. Further, the forward tilting of the rear panel of a module superposed above a module of a longer partition means improves the bin-action at the rear of the larger module below.

Figure 33:
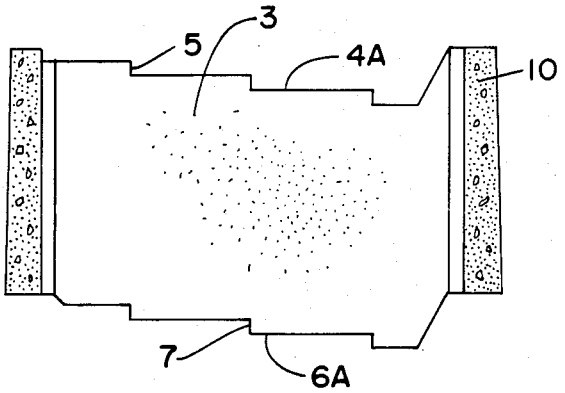
FIG. 33 is a side elevation of an advantageous form of structural module, in which the front and rear panels are generally at the same height, joined by partition elements stepped to provide a plurality of forward facing abutment elements for improved resistance to shear.

FIG. 33 shows a further embodiment of the invention where the partition means 3 is predominantly trapezoidal, with its upper and lower surfaces arranged in a sawtooth pattern, but the rear panel 10 is approximately at the same level as the front panel 1. Its contact surfaces 5 and 7 are positioned to engage mutually with similar modules above and below. Surfaces **4*a* and 6*a* may be located to bear against matching surfaces of similar modules above and below, or they may be located, so as to avoid contact with each other when it is desired that the vertical load be transferred from front panel to front panel and from rear panel to rear panel. Any module constructed according to the detail shown is able to interlock with and above any other module of the same or larger front-to-rear width. This ability will markedly decrease the variations in models and significantly reduce inventory requirements for stock piling and adjustments to molds during manufacture compared with ordinary mortise and tenon interlocked modules in use. Since the resultant force acting upon a module is always directed toward the front panel, it is not necessary to have two-way interlocking keys. This condition of a one-direction lateral loading allows the use of the sawtooth pattern shown in FIG. 33 and also the pattern shown in FIGS. 1 through 9**, etc. The uses of these and similar patterns results in improved bearing and shear behavior because significantly more area for bearing and shear resistance can be furnished, when compared with existing mortise and tenon, depending lip, or tongue and groove interlocks for wall modules.

FIG. 34 shows three cellular modules with generally rectangular partition means 55, one superimposed upon another. It is not material to the invention whether the modules transmit vertical loads from panel to panel or from partition means to partition means. What is provided is a system for the transference of lateral forces between modules which allows any size module to be superposed above any similar module regardless of the supporting modules relative size (smaller or larger) without any change in the location of the mortises 56. This ability permits a type of stacking arrangement, similar to that shown in FIGS. 36 and 46, where module sizes increase and then decrease progressively at each superposed course. The lateral forces are transferred by keys 57 which engage a single opposing pair of mortises 56 as shown also in FIG. 32, or by elongated slab-like keys 58 which span from one partition means to an adjacent one, performing the additional function of capturing the fill material more positively. FIG. 31 shows a detail of one embodiment of such a member. Wherever a rear panel 10 occurs over or under a mortise in the vertically contiguous module, bearing blocks 59 can be provided in the case of panel-bearing modules.

Figure 35:
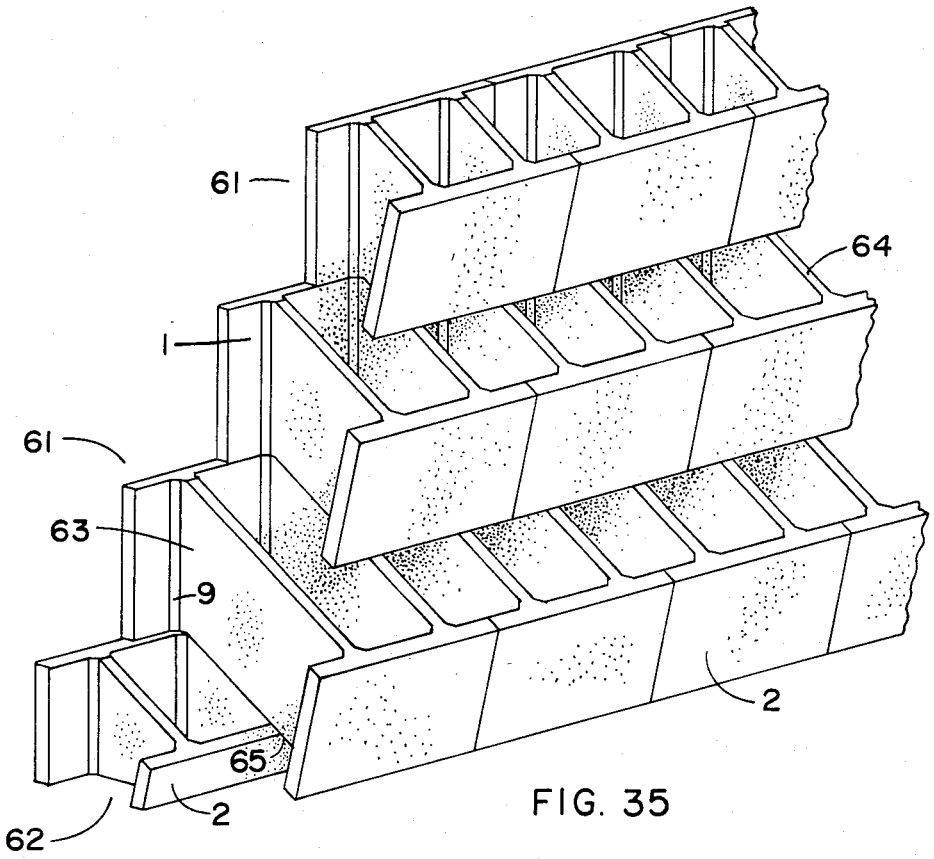
FIG. 35 is a perspective view illustrating a further modified form of the invention.

FIGS. 35 through 47 illustrate modules and assemblies of modules which utilize the principles set forth in the invention. The trapezoidal partition means is represented in its simplest form, an inclined bearing surface. In FIG. 35 an assembly of modules 61 is shown. Module 61 comprises a front panel 1, and a non-parallel rear panel 2 connected by a plurality of trapezoidal partition elements 63. As set forth in the teachings of the invention the longitudinal (principal) axes of the partition elements 63 are inclined at an acute angle from the plane of the front panel such that the upper contact surface 64 and the lower contact surface 65 are disposed at an angle which is substantially normal to the line of action of the resultant force representing all loads being transferred from superposed module to supporting module. Specifically, the principal axes of the partition elements extend downward and rearward at an angle of between 20 and 82 degrees from the plane of the front panel 1, such that the upper edge of the rear panel 2 lies substantially below a plane extending from the upper edge of the front panel, and at right angles thereto. As represented in FIGS. 41, 42, 43 and 44, the superposed module is held in place during erection of the assembly by a surface 66 perpendicular to the front panel in the zone of the intersection of the partition elements 63 with the front panel 1. As soon as a course of modules is loaded with fill material inside its cells and a commensurate quantity of retained material, the resultant loading is substantially normal (within the angle of friction between surfaces 64 and 65) to the resultant load being transferred from module to module.

Figure 36:
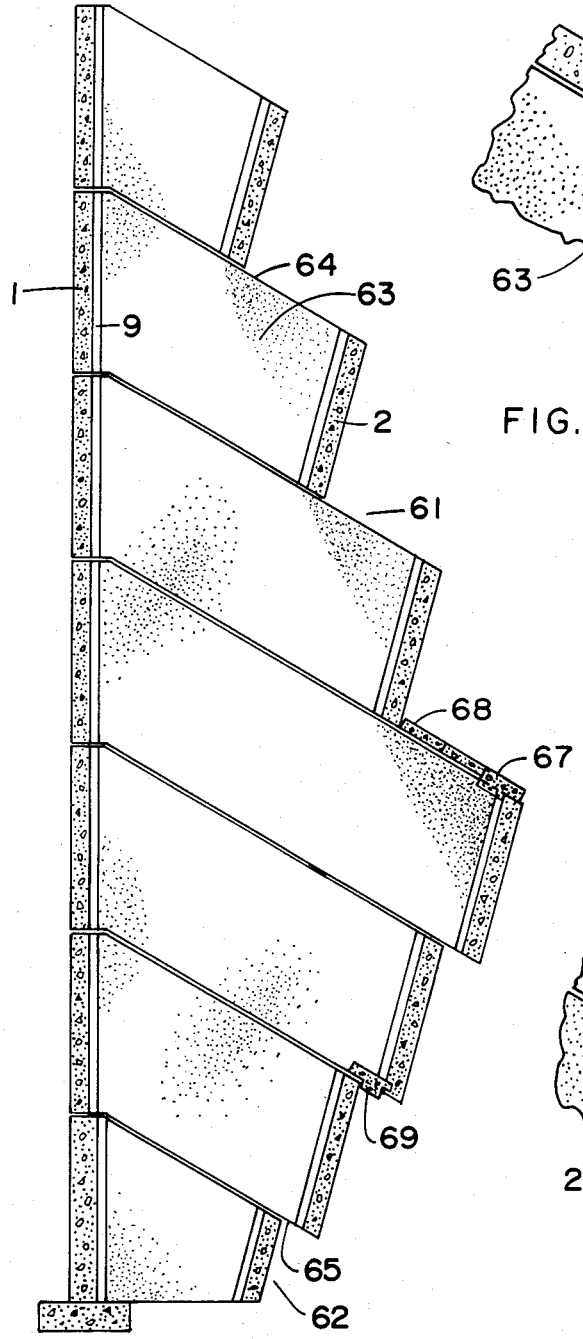
FIG. 36 is a cross sectional view of a retaining wall or the like of the general type shown in FIG. 35.

FIG. 36 illustrates an end view in cross-section of a wall assembly of modules 61. The assembly uses the beneficial pattern of module sizes described earlier in this specification where module sizes vary, starting at the base of the wall, from small to larger to smaller as the courses progress upwardly. This pattern is shown here to illustrate the facility with which different sizes of modules 61 fit one above the other in any sequence without special fabrication. This greatly simplifies the number of different shape variations which must be fabricated or carried in inventory.

Figure 37:
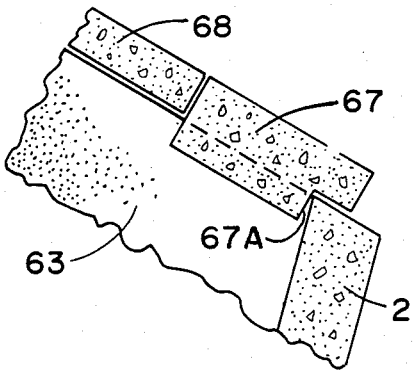
FIGS. 37 and 38 are enlarged, fragmentary cross sectional views, illustrating details of thorough retaining/supporting element incorporated in the assembly of FIG. 36.
Figure 38:
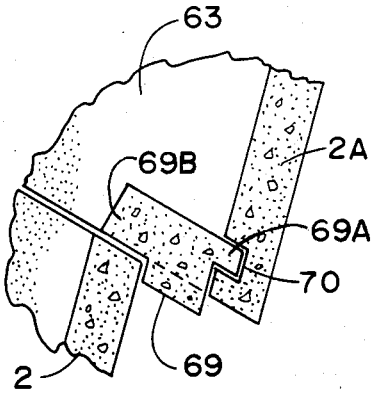

FIGS. 37 and 38 show special closure slabs which may be incorporated in a wall assembly constructed of modules similar to module 61. On the top surface of a module which does not support a larger module, the exposed top of the cells containing fill material may be, if desired, covered by a closure slab 67. If a smaller module is superposed, the additional width exposed may be covered by adding one or a plurality of closure slabs 68. Closure slab 67 is formed to contain a depending portion 67A which fits between adjacent partition elements and which engages the surface of the rear panel which faces the inside of the module. Closure slab 68 may be rectangular in cross-section.

In some cases it may be desirable to close the open space at the bottom of a module which overhangs its supporting module. Closure slab 69, shown in FIG. 38, fits between adjacent partition elements at the bottom of a module and accomplishes this task. A recessed keyway 70 is provided in rear panel 2A to support the rearmost edge 69A of the slab while the opposite edge 69B is supported on the top surface of the lower module's rear panel.

Figure 39:
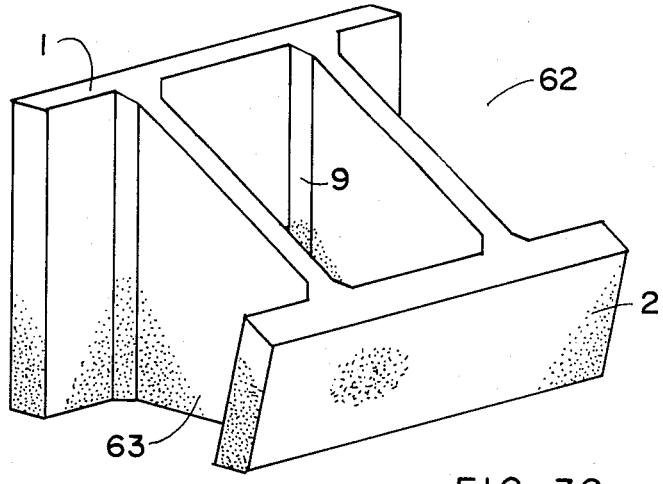
FIGS. 39, 40 are perspective views of special configurations of base modules, for use in wall assemblies such as shown in FIGS. 35, 36.
Figure 40:
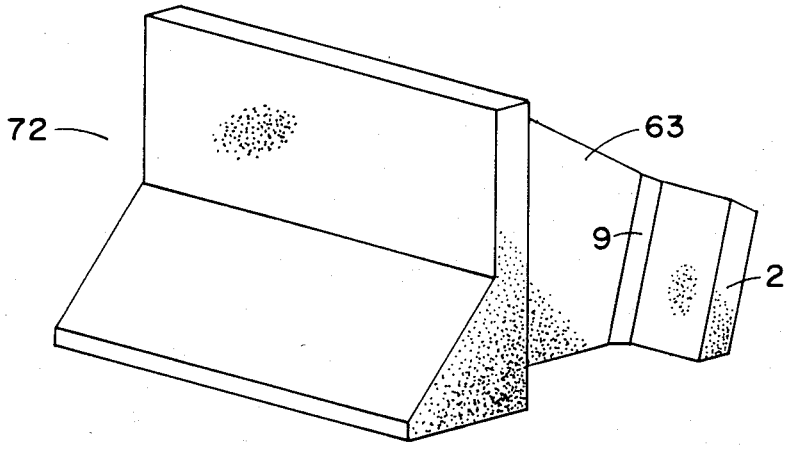

FIGS. 39 and 40 show two possible configurations of base modules 62, 72 for wall assemblies using module 61. The base module 62 is simply a module 61 truncated at the bottom to lie along the subgrade of the wall. Base module 72 shown in FIG. 40 is similar to base module 62 but the exterior bottom surface of the front panel has been extended substantially forward to move the pivot point, about which an entire wall assembly tends to rotate, to a more beneficial location.

Figure 41:
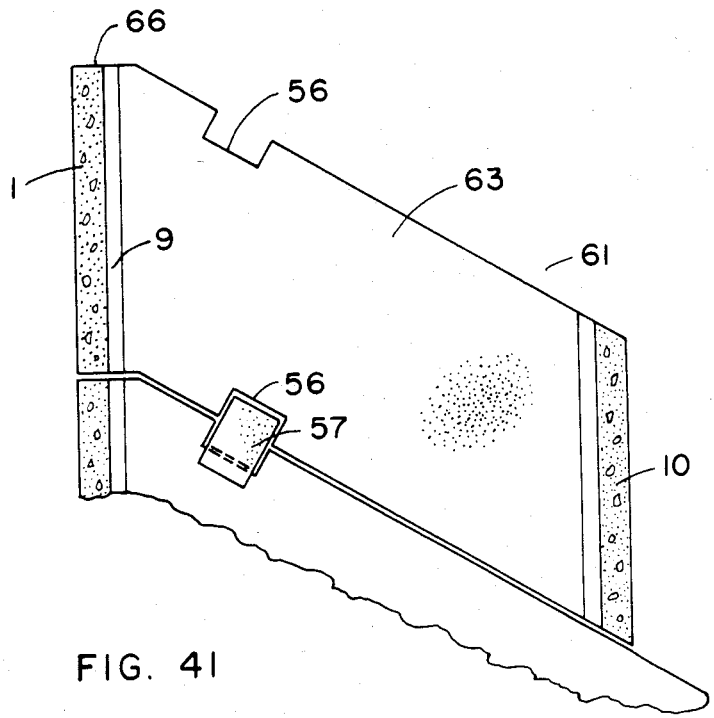
FIGS. 41 and 42 are cross sectional and top plan views respectively of a modified structural module configuration providing for aligned pairs of mortise notches between vertically adjacent modules, for the reception of keying elements.
Figure 42:
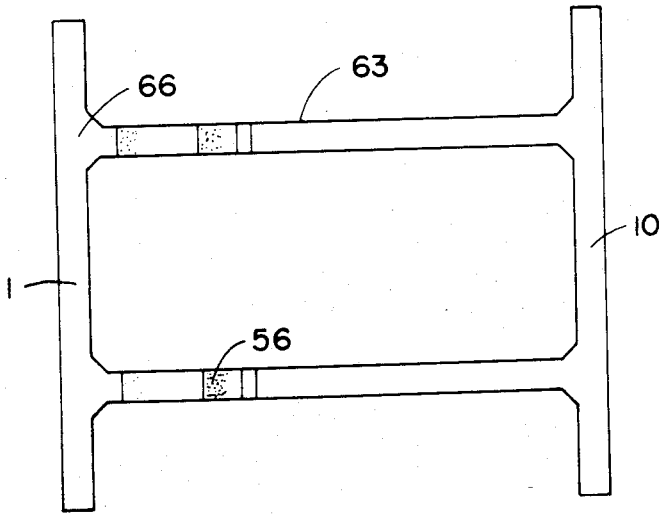
Figure 43:
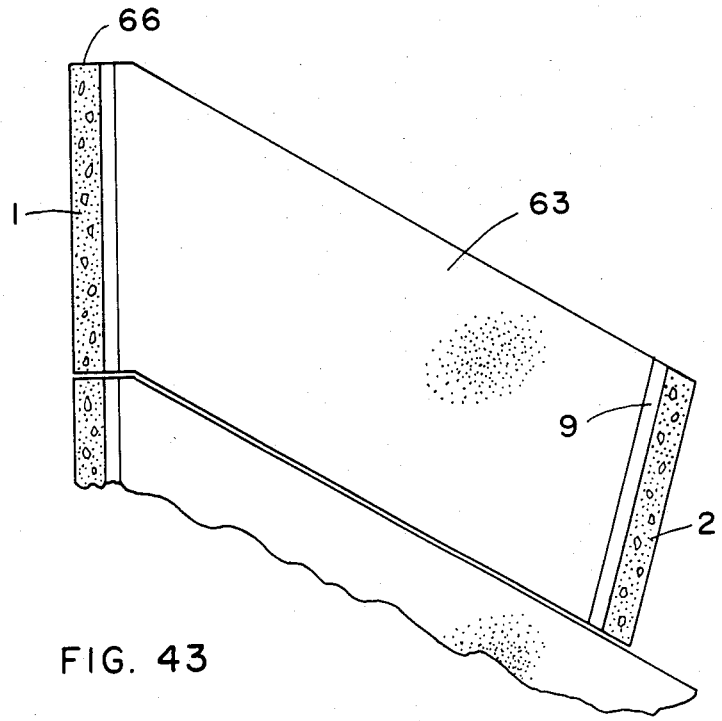
FIGS. 43 and 44 are cross sectional and top plan views respectively, similar to FIGS. 41, 42, where the module is provided with an inclined rear panel.
Figure 44:
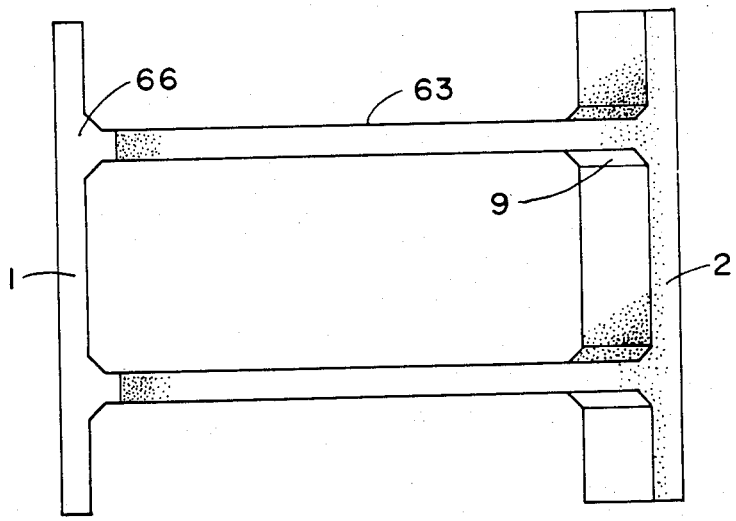

FIGS. 41 and 42 show a module 61 with a vertical rear panel 10 and with mortises 56 provided in the upper and lower edges of the partition elements 63A. These mortises are dimensioned to accept a keying block 57 or slab 58 similar to those illustrated in FIGS. 31, 32 and 34. Key 57 is shown in FIG. 41 but a slab 58 may be used with equal facility. The purpose of the key is to secure the position of the blocks during assembly and until the lateral force from the retained material is allowed to act. FIGS. 43 and 44 show a similar type of module but with an inclined rear panel.

Figure 45:
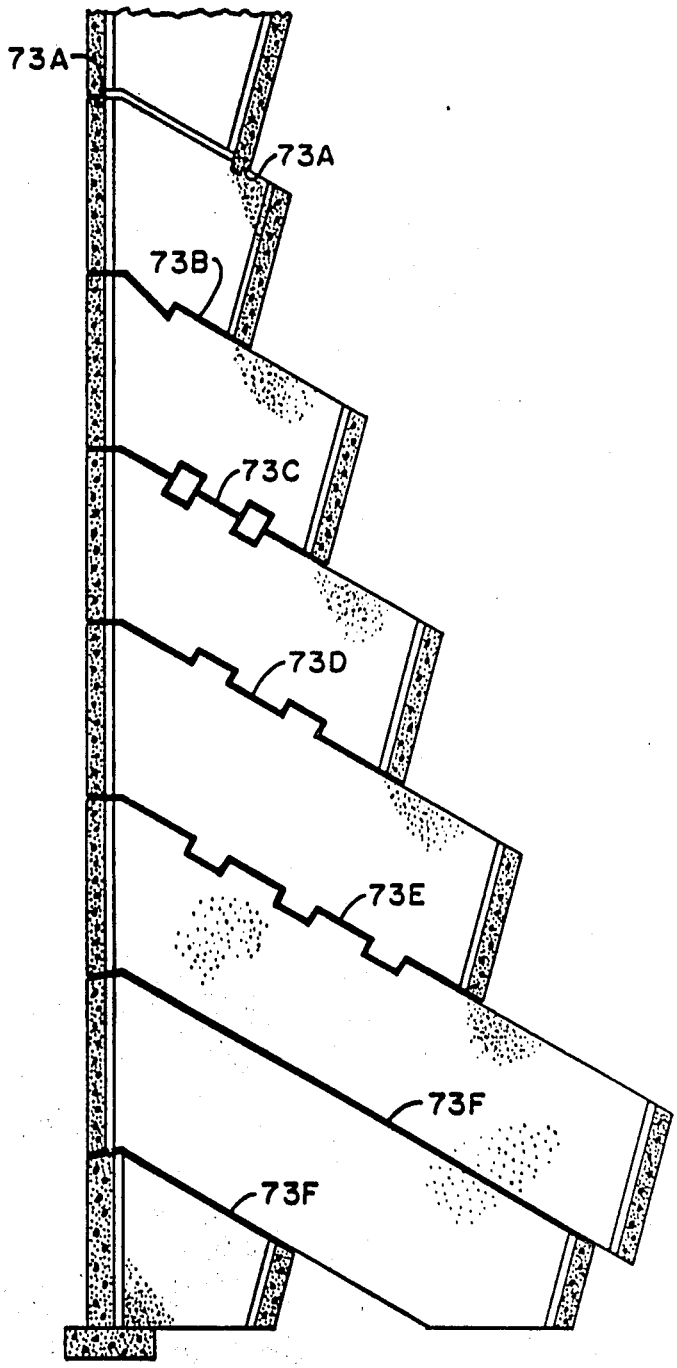
FIG. 45 is an end elevational view of a retaining wall or the like constructed of various modified forms of structural modules having advantageous load bearing characteristics.

FIG. 45 illustrates several keying mechanisms which may be used to secure a superposed module. Joint 73A is secured by depending keys in the front and rear panels which mate with keyways in the top of the front panel and in the tops of the generally trapezoidal partition means of the lower module. Joint 73B is secured by a wedge-shaped protrusion and matching recess. Joint 73C is secured by one or a plurality of key locks (may be a shelf-like member 58) which fit in recesses (such as mortises) placed in contraposition in the contact surfaces of vertically contiguous modules. Joint 73D and 73E are secured by standard mortise and tenon keys. In joint 73D the tenons extend upward while in 73E the tenons extend downward into their mating mortises. Joints 73F are planer contact surfaces which are secured during erection by a reversal in the direction of inclination of the contact surfaces in the zone of the intersection of the partition means with the front panel. This reversal of the incline of the surfaces at the face of the wall (downward toward the front) would provide the additional benefit of decreasing the quantity of water likely to seep through the joint from the exterior surface of the wall. FIG. 45 is intended only as a composite drawing of representative means to secure the modules.

Figure 46:
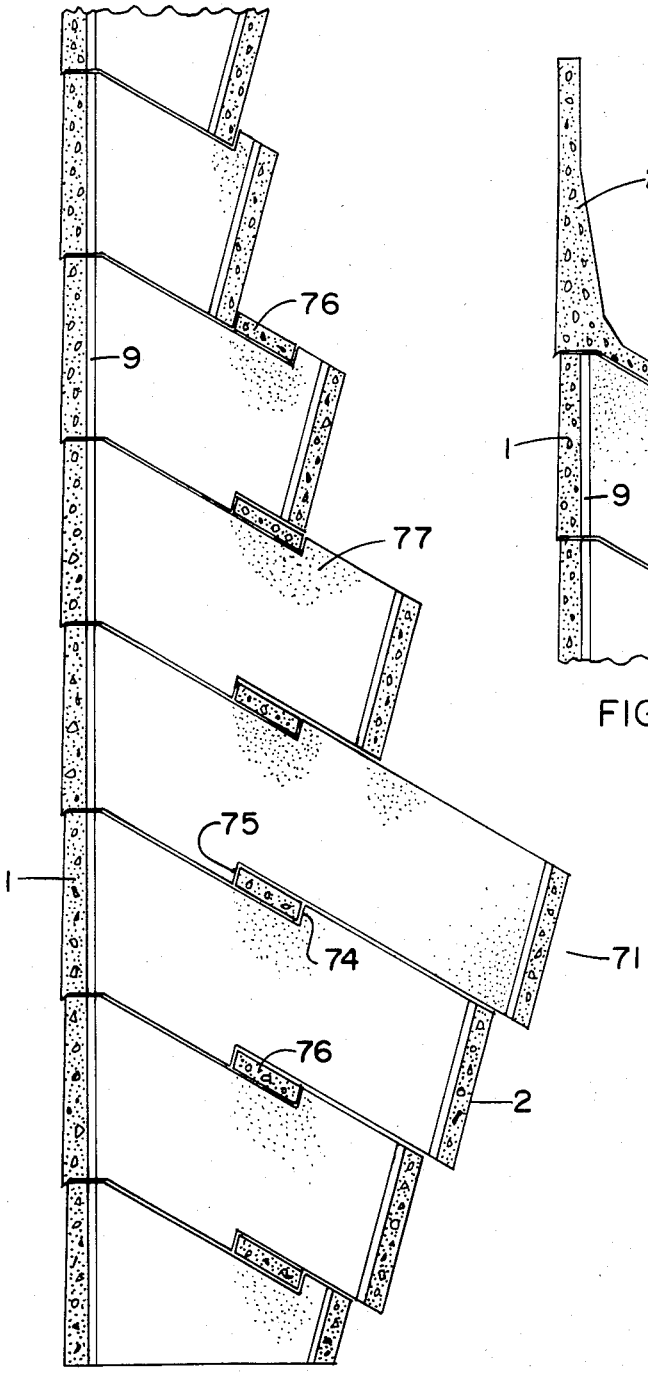
FIGS. 46 and 47, together, constitute a cross sectional view of a further modified form of retaining wall assembly utilizing an advantageous form of interlocking means between vertically adjacent modules.

FIGS. 46 and 47 show an assembly of wall modules 71 which are keyed in a manner which provides additional benefits. Each module 71 has the rearmost portion of its partition means displaced upwardly to form a pair of interlocking surfaces when the module is placed in vertical contiguity with a similar module 71. Interlocking surface 74 is on the top of each partition means 77, and interlocking surface 75 is on the bottom of each partition means 77 except the partition means of the smallest module, which is too small to contain surface 75. The interlocking surfaces 74 for the top edge all occur at the same distance from the front panel 1 for each size module 71, except the smallest. Likewise the interlocking surfaces 75 on the bottom edge all occur at the same distance from the front panel 1 for each size module 71 except the smallest. The interlocking surfaces 74 and 75 could be placed at the same distance from the front panel 1 allowing them to mate directly, but in the assembly illustrated in FIGS. 46 and 47, surface 75 is placed a substantial distance forward (toward front panel 1) of surface 74. This separation of the mating surfaces allows the placement of a slab 76 which spans between adjacent partition means, and which produces substantial benefits to the wall structure. The slabs 76 impart additional overturning resistance to the wall. When slabs 76 occur behind a superposed module they direct the overturning force in a more downward direction which is beneficial in effect.

When slabs 76 occur within the cells of a wall assembly they very effeciently engage the forces present in the fill material and transfer these forces to the partition means upon which they are supported. Since the slabs 76 are oriented in the same direction as the joints between partition means, they are substantially normal to the direction of the forces in the fill material and therefore very effective. FIG. 47 shows how top unit 23, shown also in FIG. 17, may be used effectively in combination with modules 71.

Figure 49:
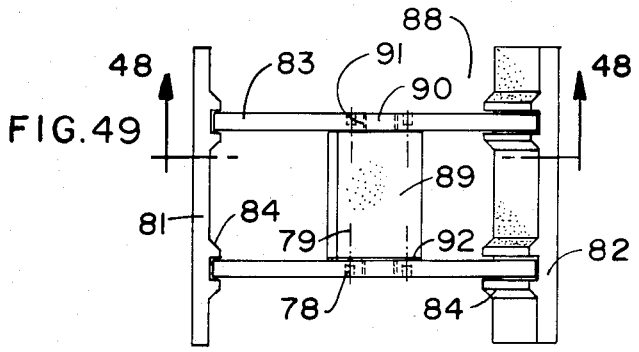
FIG. 49 is a top plan view of a structural module according to the invention which is cast in individual components and assembled before installation.
Figure 48:
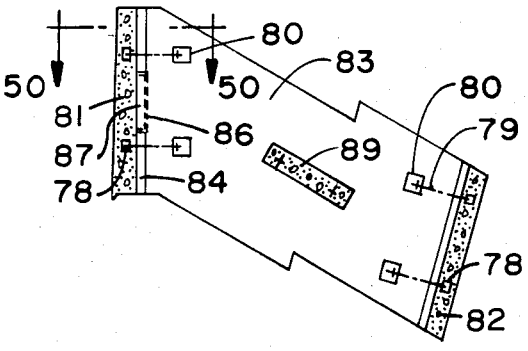
FIG. 48 is a cross sectional view taken on line 48—48 of FIG. 49.
Figure 50:
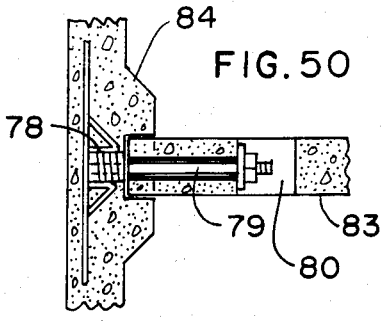
FIG. 50 is an enlarged fragmentary cross sectional view taken on line 50—50 of FIG. 48.

FIGS. 48 through 50 show a module 88 substantially the same as module 11 or 71, wherein each element of the module, front panel 81, rear panel 82, and partition means 83, is fabricated separately and subsequently assembled using a plurality of fastening means which, in the example illustrated, are interengaging threaded elements. In the method illustrated a female threaded insert 78 is cast integrally in one of the module's main elements, and the element with which it is to be connected is cast with a cylindrical hole to receive the male threaded fastener 79. The threaded elements 78 and 79 are positioned to align correctly with each other when the module's main elements are properly positioned with respect to each other. When desired, pockets 80 can be provided in one or both of the module's elements to allow access in securing the threaded fastening means. It is desirable to restrict stresses in fasteners of the type illustrated to tensile stress. Therefore, other means must be provided to transfer shear in any direction in which it may possibly occur. In the example shown a mortise and tenon shear transfer interlock is designed to function in two planes. Shear may be transferred laterally in either direction by the compression of the edge of partition means against the ribs 84, cast on the inside of the front and rear panels. Shear, in a direction parallel with the ribs 84, is transferred by a mortise 86 and tenon 87 cast between the position of the ribs 84.

Some of the advantages of casting the module elements separately are: simpler and more economical mold requirements (most elements may be cast in a horizontal plane), better adaptability to mass production methods, less waste when one of the elements is damaged during fabrication, in shipping, or in erection, and simpler and smaller inventory of useable elements since the elements can be mutually interchanged. A cosmetically damaged front panel may be substituted for a rear panel if the connecting threaded elements and shear transfer keys are kept in matching locations. A structurally damaged element can be discarded with relatively little financial loss.

It will usually be economically advantageous to assemble the segmental module 88 away from the erection site. In order to be able to handle safely a non-integral module it is advisable to provide a stiffening diaphragm to prevent lateral warping of the unit such as would occur if a change were allowed to occur in the angle, measured in a horizontal plane, between the partition elements and the front and rear panels. One method of stiffening is shown in FIGS. 48 and 49 wherein a slab 89 is placed between the partition means during assembly of the module. In the example illustrated, vertical and horizontal shear is transferred through a tenon 90 cast at the end of slab 89. Tenon 90 fits with minimal clearances into a mortise 91 cast in the body of the partition means 83. A plurality of fastening means, threaded connectors are shown, hold the shoulders 92 at the ends of slap 89 firmly against the sides of partition means 83 and affect a rigid diaphragm action. An alternative method of stiffening is to attach gussets at the intersections of the partition means 83 with front panel 81 and rear panel 82. One gusset in each of two diagonally opposite corners would be the minimum requirement. The gussets should be connected by threaded connectors and shear transfer keys in a manner similar to the connection of slab 89.

Modules, whose partition means carry the principal wall loads and which transfer these loads directly to partition means upon which they bear, are more readily constructed of separately cast elements because the stresses required to be transferred at the connecting joints are minimal and the joint is therefore simpler and more economical. For this reason embodiments of this invention which have partition means which bear directly upon one another are particularly advantageous.

It should be understood, or course, that the specific forms of the invention herein illustrated and described are intended to be representative only, as many modifications thereof may be made without departing from the clear teachings of the disclosure. Accordingly, reference should be made to the following appended claims in determining the full scope of the invention.

We claim:

1. A prefabricated cellular module which, when placed in vertical and horizontal relationship with appropriately proportioned like modules, is used in constructing retaining walls, sea walls, and the like, said module comprising (a) a front panel, (b) a rear panel, (c) at least one vertically oriented partition means connecting said front panel and said rear panel, wherein, for a substantial length of said partition means the thickness of said partition means is substantially less than the overall width of the module, thereby creating at least one cellular chamber with vertical through-opening(s), and (d) said partition means, and said front panel and said rear panel being rigidly interconnected in a geometrical relationship such that, when the module is in its erected position in a wall structure, the uppermost and lowermost surfaces of said partition means are each disposed downwardly from said front panel at an angle, as measured from a line perpendicular to the plane of the front face of said wall structure, so that the bottom edge of said rear panel is situated at an elevation substantially below a line extending from the lower edge of said front panel perpendicular to the plane of the front face of said wall structure.

2. A prefabricated cellular module as set forth in claim 1, wherein said rear panel is positioned in a plane set at an angle with the plane of said front panel.

3. A prefabricated cellular module as set forth in claim 1, wherein (a) said partition means comprise spaced apart left and right partition elements, (b) said partition elements being spaced apart at such a distance that the modules can be stacked in a pattern which allows the front panel of a superposed module to overhang the front panels of two modules in the course immediately beneath it, with the left partition element of said superposed module vertically aligned with the right partition element of a module in the lower course, and the right partition element of said superposed module vertically aligned with the left partition element of another module in the lower course, such that said partition elements are aligned in a stack.

4. A prefabricated cellular module as set forth in claim 1, wherein (a) said partition means comprise one or more partition elements, (b) said partition elements having upper and lower surface contours of irregular shape, whereby back-to-front shear forces between vertically adjacent modules are resisted by said partition elements.

5. A prefabricated cellular module as set forth in claim 4, wherein said upper and lower surface contours comprise a plurality of stepped surfaces of a generally saw tooth configuration.

6. A prefabricated cellular module as set forth in claim 4, wherein said surface contours comprise mutually interengaging mortise and tenon means.

7. A prefabricated cellular module as set forth in claim 4, wherein (a) said surface contours comprise mutually facing notched-out areas of said partition elements, and (b) independent locking elements are provided for engaging the notched-out areas of partition elements of vertically adjacent modules.

8. A prefabricated cellular module as set forth in claim 7, wherein said independent locking element(s) and said mutually facing notched-out areas are configured in such a manner that either vertical movement and/or pivoting of the superposed module with respect to the supporting module(s) is accommodated by said independent locking element(s).

9. A prefabricated cellular module as set forth in claim 7, wherein said mutually facing notched-out areas and said independent locking elements are so configured, that said surface contours and said independent locking elements are capable of transmitting lateral forces in one direction only.

10. An assembly according to claim 7, wherein said locking elements comprise slab-like members, portions of said slab-like members extending laterally from said partition means and providing surfaces capable of engaging some of the fill material within said cellular chamber(s) of said module(s).

11. A prefabricated cellular module as set forth in claim 1, wherein upper and lower planes, defined respectively by the upper and lower edges of said front and rear panels, lie at angles of from 20 to 82 degrees to the plane of the front face of said wall structure.

12. A prefabricated cellular module as set forth in claim 11, wherein said uppermost and lowermost surfaces of said partition means are substantially parallel to each other.

13. A prefabricated cellular module as set forth in claim 1, wherein said rear panel lies at an angle to said front panel of at least about 80 degrees.

14. A prefabricated cellular module as set forth in claim 1, wherein (a) said partition means comprise laterally spaced-apart partition elements, (b) the height and geometry of said partition elements being such in relation to the height and geometry of the front and rear panels that, in a vertical stack of modules, the loads being borne by superposed modules are supported by said partition elements of lower modules.

15. A prefabricated cellular module as set forth in claim 1, wherein said partition means have complementary non-linear upper and lower surface configurations whereby, when said modules are stacked vertically to form a wall or the like, vertically adjacent modules are keyed together to resist lateral forces.

16. A prefabricated cellular module as set forth in claim 1, wherein a plurality of said prefabricated cellular modules are superposed one upon the other in a vertical arrangement such that the module which extends rearward the farthest into the retained material lies at or very near the bottommost elevation at the heel of the wall, and each succeeding module superposed above is dimensioned so that it extends either the same distance rearward into the embankment or a lesser distance.

17. A prefabricated cellular module as set forth in claim 1, wherein an assembly of said prefabricated structural modules are superposed one upon the other in a vertical arrangement such that the farthest rearward extending module, the module which extends rearward the farthest into the retained material, lies a considerable distance above the bottommost elevation at the heel of the wall, and each succeeding module superposed above said farthest rearward extending module is dimensioned so that it extends either the same distance rearward into the retained material or a lesser distance, and those modules below said farthest rearward extending module are of progressively smaller dimensions as they approach the bottommost module at the base of the wall.

18. A wall structure comprising an assembly of prefabricated cellular module(s) as set forth in claim 1, further including a base module comprising a front panel, and partition means whose uppermost surface is disposed downwardly from said front panel at an angle of between 8 degrees and 70 degrees as measured from a line perpendicular to the plane of the front face of said wall structure, wherein said base module supports a portion of the superposed wall structure.

19. A wall structure as set forth in claim 18, wherein said front panel of said base module includes a base which extends forward from the plane of the assembled wall structure's front face to form an extended toe.

20. A wall structure comprising an assembly of prefabricated cellular modules as set forth in claim 1, further including a top unit comprising (a) a front panel rigidly connected to (b) one or more projecting arms which extend downward along the rear surface of the front panel of the supporting module, (c) a means for transmitting vertical and lateral forces from said top unit to the supporting module, and (d) a means for laterally restraining the lower end of said projecting arms against the rear surface of the module's front panel in a manner which prevents rotation of said top unit.

21. A wall structure comprising an assembly of prefabricated cellular modules as set forth in claim 1, further including a top unit comprising (a) a front panel rigidly connected to (b) one or more projecting arms which extend rearward and downward at an angle of between 8 degrees and 70 degrees as measured from a line perpendicular to the plane of the front face of said wall structure, and (c) a means for transmitting vertical and lateral forces from said top unit to the cellular module or to the base module upon which it is superposed.

22. A prefabricated cellular module as set forth in claim 1, wherein said partition means are of sufficient vertical dimension, in relation to the vertical dimensions of said front and rear panels, that, when assembled with like modules to form a wall, the lower surface areas of said partition means rest in direct contact with, and are supported by the upper surface areas of the partition means of the module immediately beneath it.

23. A prefabricated cellular module which, when placed in vertical and horizontal relationship with appropriately proportioned like modules, is used in constructing retaining walls, sea walls, and the like, said module comprising (a) a front panel, (b) a rear panel, (c) at least one vertically oriented partition means connecting said front panel and said rear panel, wherein, for a substantial length of said partition means the thickness of said partition means is substantially less than the overall width of the module, thereby creating at least one cellular chamber with vertical through-opening(s), and (d) said partition means, and said front panel and said rear panel being rigidly interconnected in a geometrical relationship such that, when said modules of differing front to rear dimensions are assembled in a wall structure, the distance from the bottom of the front panel to the bottom of the rear panel, as measured parallel to the plane of the front face of said wall structure, is greater for modules with longer partition means than for like modules with shorter partition means.

24. A prefabricated cellular module which, when placed in vertical and horizontal relationship with appropriately proportioned like modules, is used in constructing retaining walls, sea walls, and the like, said module comprising (a) a front panel, (b) a rear panel, (c) at least one vertically oriented partition means connecting said front panel and said rear panel, wherein, for a substantial length of said partition means the thickness of said partition means is substantially less than the overall width of the module, thereby creating at least one cellular chamber with vertical through-opening(s), and (d) said partition means, and said front panel and said rear panel being rigidly interconnected in a geometrical relationship such that, when the module is in its erected position in a wall structure, wherein at least one of the upper and lower surface contours of said partition means comprises a plurality of contiguous surface-contour segments, in a generally sawtooth configuration, wherein the front-to-rear distance of each said surface-contour segment is significantly less than the front-to-rear distance of said partition means, and wherein each said surface-contour segment comprises one or a plurality of surface(s) generally disposed in a front-to-rear direction, and one or a plurality of surface(s) generally disposed in a downward direction, and wherein the rear portion of each said surface-contour segment ends at an elevation substantially below a line extending from the front portion of the segment perpendicular to the plane of the front face of said wall structure.

25. A prefabricated cellular module as set forth in claim 24, wherein said partition means is of sufficient vertical dimension to cause the downward-facing lower surface of the partition means of a superposed module to engage with the upward-facing surface of the partition means of a module upon which it lies supported.

26. A prefabricated cellular module as set forth in claim 24, wherein said surface-contour segment begins with a surface generally disposed in a front-to-rear direction, and ends with a surface generally disposed in a downward direction.

27. A prefabricated cellular module as set forth in claim 24, wherein said surface-contour segment begins with a surface generally disposed in a downward direction, and ends with a surface generally disposed in a front-to-rear direction.

28. A prefabricated cellular module as set forth in claim 24, wherein each said surface-to-contour segment begins at its highest elevation and ends at its lowest elevation, with respect to a line perpendicular to the plane of the front face of said wall structure.

29. A prefabricated cellular module comprising front and rear panels and a plurality of substantially vertically-oriented connecting elements joining said panels wherein said connecting elements are spaced apart creating a vertical through-opening between said connecting elements such that, in an assembly of said modules, at least one module lies a substantial distance away from a module laterally adjacent to it, creating an open area between laterally adjacent front panels of said modules, said open area lying between two of the connecting elements of a single module located above or below, with provision for securing a front filler panel inserted between two laterally adjacent modules in said open area, at least one connecting element of each of said laterally adjacent modules being in vertical alignment with connecting elements of a single vertically adjacent module, there being a positive means of transferring lateral forces between the vertically aligned superposed connecting elements.

30. An assembly of prefabricated cellular modules as set forth in claim 29, further including (a) a plurality of filler panels, and (b) said open areas between front panels are filled by inserting said filler panels, (c) said filler panels being held in place by adjacent modules.

31. An assembly of prefabricated cellular modules as set forth in claim 30, wherein said filler panels are fabricated and placed so that the outer surfaces thereof lie in the same plane as the outer surfaces of the front panels of adjacent modules.

32. An assembly of prefabricted cellular modules as set forth in claim 30, wherein said filler panels are fabricated and placed so that the outer surfaces thereof lie in a plane offset toward the rear of the module, resulting in an area recessed from the outer surfaces of the front panels of adjacent modules.

33. A prefabricated cellular module as set forth in claim 30, wherein said filler panels are fabricated and placed so that the outer surfaces thereof lie in a plane offset forward of the plane of the front panels, creating an area which protrudes forward of the outer surfaces of the front panels of adjacent modules.

34. A prefabricated cellular module as set forth in claim 29 wherein said connecting elements are proportioned such that the height and geometry of said connecting elements are such in relation to the height and geometry of the front and rear panels that, in a vertical stack of modules, the loads borne by superposed modules are supported by said connecting elements.

35. A prefabricated cellular module as set forth in claim 29, wherein, in an assembly of said modules, like open areas between adjacent rear panels are filled by inserting separate filler panels which are held in place by the adjacent modules.

36. A prefabricated cellular module which, when placed in vertical and horizontal relationship with appropriately proportioned like modules, is used in constructing retaining walls, sea walls, and the like, said module comprising a front panel, a rear panel and one or a plurality of vertically oriented partition means rigidly interconnecting said panels, thereby creating at least one cellular chamber with vertical through-opening(s), said partition means being provided on its(-their) respective upper and lower edges with one or a plurality of oppositely-facing mortise notches, said mortise notches and said partition means being so arranged that, in an assembly of modules, at least one pair of oppositely-facing mortise notches on said partition means of vertically adjacent modules is configured in such a manner that they can accept a means for keying, said means for keying being capable of transmitting lateral forces between said vertically adjacent partition means by engaging said oppositely-facing mortise notches, and said mortise notches and said means for keying being configured in such a manner that either vertical movement and/or pivoting of the superposed module with respect to the supporting module is accommodated by said means for keying.

37. An assembly according to claim 36, wherein said means for keying is a slab-like member, portions of said slab-like member extending laterally from said partition means and providing a surface, capable of engaging some of the fill material within said cellular chamber(s) of said module(s).

38. An assembly according to claim 37, wherein said slab-like members span the space between at least two adjacent partition means.

39. An assembly according to claim 36, wherein said rear panel is positioned in a plane set at an angle with the plane of said front panel.

40. An assembly according to claim 36, wherein the upper edge of said rear panel lies substantially on a level with a line extending from the upper edge of said front panel at right angles thereto.

41. A wall structure comprising an assembly of prefabricated cellular modules according to claim 36, wherein a line extending from the lower edge of said front panel to the lower edge of said rear panel is substantially perpendicular to the plane of the front face of said wall structure.

42. A prefabricated cellular module according to claim 36, which, when placed in vertical and horizontal relationship with appropriately proportioned like modules, the respective vertical dimensions and geometric configurations of said panels and said partition means being such that, in an assembled relationship, downward loads in said wall are largely transferred from the partition means of one module to the partition means of a supporting module, said front and rear panels being largely isolated from said downward loads.

43. A prefabricated cellular module according to claim 36, wherein said means for keying and said oppositely-facing mortise notches in said partition means are so configured, that said means for keying is capable of transmitting lateral forces in one direction only between partition means by engaging said oppositely-facing mortise notches.

44. A retaining wall, sea wall, or the like comprising a plurality of prefabricated cellular modules placed in vertical and horizontal relationship, at least certain of said modules comprising (a) a front panel, (b) a rear panel, (c) at least one vertically oriented partition means connecting said front panel and said rear panel, wherein, for a substantial length of said partition means, the thickness of said partition means is substantially less than the overall width of the module, thereby creating at least one cellular chamber with vertical through-opening(s), (d) intermediate dividing panel means, positioned to extend between adjacent partition means, said partition means having (e) a fastening means by which said intermediate dividing panel means are interposed and secured between said front panel and said rear panel, said intermediate dividing panel means constituting means for increasing a module's total ability to engage the weight of additional enclosed fill material contained within said cellular chamber by engaging some of said fill material by the action of friction against the panel surfaces, and said intermediate dividing panel means being connected to said partition means which is able to support loads which the fill material inside the cellular chamber may impose upon said intermediate dividing panel means.

45. A retaining wall as set forth in claim 44, wherein said fastening means is oriented such that said intermediate dividing panel means are positioned in planes set parallel with the planes of said front panels.

46. A retaining wall as set forth in claim 44, wherein said fastening means is oriented such that said intermediate dividing panel means are positioned in planes set at an angle with the planes of said front panels.

47. A retaining wall as set forth in claim 44, wherein said intermediate dividing panel means and said partition means are integrally constructed in one piece.

48. A retaining wall as set forth in claim 44, wherein said fastening means comprises (a) slots formed in the vertical sides of said partition means into which lateral edges of said intermediate dividing panel means are rigidly secured against rotation, and said slots serving to transfer to said partition means the component of the weight of interior fill material supported by said intermediate dividing panel means perpendicular to the plane of said intermediate dividing panel means, and (b) bearing shelves through which the component of the weight of interior fill material, supported by said intermediate dividing panel means parallel to the planes of said intermediate dividing panel means, is transferred to said partition means.

49. A wall structure, such as a retaining wall, sea wall, or the like, comprising a plurality of prefabricated structural top units placed in horizontal relationship with appropriately proportioned like units, at least certain of said top units comprising (a) a front panel rigidly connected to (b) one or more projecting arms which extend downward and rearward from the lower edge region of said front panel at an angle of between 8 degrees and 70 degrees as measured from a line perpendicular to the plane of the front face of said wall structure, (c) means forming a base structure supporting at least the forward lower portions of said top units, and (d) cooperating means on said top units and said base structure for resisting forward lateral forces exerted upon said top units.

50. A wall structure as set forth in claim 49, wherein said one or more projecting arms are dimensioned and located such that it/they create(s) one or a plurality of vertical through-opening(s) within said arms, or between adjacent arms.

* * * * *